US006561504B2

(12) United States Patent
Mlejnek et al.

(10) Patent No.: US 6,561,504 B2
(45) Date of Patent: May 13, 2003

(54) FINISHER WITH SINGLE ROLLER FOR FRICTIONALLY MOVING EACH SHEET

(75) Inventors: Daniel George Mlejnek, Lexington, KY (US); William Joseph Thornhill, Lexington, KY (US); Thomas Campbell Wade, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 70 days.

(21) Appl. No.: 09/822,982

(22) Filed: Mar. 30, 2001

(65) Prior Publication Data

US 2002/0195767 A1 Dec. 26, 2002

(51) Int. Cl.[7] ..... B42C 1/12

(52) U.S. Cl. ..... 270/58.12; 270/58.17; 271/236; 271/220

(58) Field of Search ..... 271/234, 236, 271/241, 251, 220; 270/58.12, 58.16, 58.17, 58.27; 399/410, 407

(56) References Cited

U.S. PATENT DOCUMENTS

| | | | | |
|---|---|---|---|---|
| 1,217,650 A | | 2/1917 | Snyder | |
| 3,669,447 A | | 6/1972 | Turner et al. | |
| 3,970,299 A | | 7/1976 | Berger, Jr. et al. | |
| 4,049,256 A | | 9/1977 | Church et al. | |
| 4,060,237 A | | 11/1977 | Degen et al. | |
| 4,257,587 A | | 3/1981 | Smith | |
| 4,319,743 A | | 3/1982 | Rood | |
| 4,379,549 A | | 4/1983 | Mizuma | |
| 4,500,085 A | * | 2/1985 | Rayfield et al. | 271/207 |
| 4,548,399 A | | 10/1985 | Heider et al. | |
| 4,925,172 A | | 5/1990 | Christy et al. | |
| 5,013,021 A | | 5/1991 | Johdai et al. | |
| 5,020,785 A | * | 6/1991 | Kosaka et al. | 270/58.11 |
| 5,021,837 A | | 6/1991 | Uto et al. | |
| 5,037,077 A | | 8/1991 | Kubota et al. | |
| 5,120,046 A | * | 6/1992 | Mandel et al. | 271/220 |
| 5,120,047 A | * | 6/1992 | Mandel et al. | 271/220 |
| 5,131,644 A | | 7/1992 | DuBois | |
| 5,201,515 A | | 4/1993 | Funk | |
| 5,288,062 A | | 2/1994 | Rizzolo et al. | |
| 5,346,204 A | * | 9/1994 | Endoh et al. | 271/220 |
| 5,415,390 A | * | 5/1995 | Guerrero | 271/215 |
| 5,435,535 A | | 7/1995 | Suzuki et al. | |
| 5,473,420 A | | 12/1995 | Rizzolo et al. | |
| 5,791,644 A | | 8/1998 | Regimbal et al. | |

* cited by examiner

*Primary Examiner*—Patrick H. Mackey
(74) *Attorney, Agent, or Firm*—John A. Brady

(57) ABSTRACT

A single aligning roller is disposed at angle to each of two reference barriers to which a printed sheet is to be advanced so as to be aligned at a specific location for stapling. The aligning roller exerts a greater force towards the reference barrier further from the adjacent edge of the printed sheet to be aligned. The aligning roller is preferably at 66° to the reference barrier further from the adjacent edge of the printed sheet to be aligned.

5 Claims, 30 Drawing Sheets

FINISHER WITH SINGLE ROLLER FOR FRICTIONALLY MOVING EACH SHEET

RELATED APPLICATIONS

U.S. patent application of Michael Kurt Gordon et al for "Finisher With Sheet Placement Control," Ser. No. 09/774,852, filed Jan. 31, 2001. U.S. patent application of Jeffery Allen Ardery et al, for "Finisher With Frictional Sheet Mover," Ser. No. 09/793,360, filed Jan. 31, 2001. U.S. patent application of Jeffery Allen Ardery et al, for "Sheet Beam Breaker," Ser. No. 09/822,530, filed Mar. 30, 2001. U.S. patent application of Thomas C. Wade for "Output Tray Having An Increased Capacity For Stapled Sheets," Ser. No. 09/822,614, filed Mar. 30, 2001.

FIELD OF THE INVENTION

This invention relates to a finisher for stacking sheets of paper or similar material moving in a predetermined direction in a specific alignment at a predetermined location and, more particularly, to a finisher for stacking sheets in which motion of each sheet is directed to two substantially perpendicular reference barriers defining a corner with a first edge of each sheet engaging the closer of the two reference barriers before a second edge of the sheet engages the other reference barrier.

BACKGROUND OF THE INVENTION

Various arrangements have previously been suggested for sequentially aligning each sheet of paper or similar material forming a stack of sheets at a specific location on a support. This alignment of sheets in a stack has been utilized to enable stapling of a selected number of the sheets at a specific location on each stack of the stapled sheets, for example.

With imaging forming devices, particularly a printer or copier, for example, it is desired to be able to staple a predetermined number of sheets as they are fed separately from the image forming device. Each sheet is fed from the image forming device through exit corrugation rollers to a support surface. Each sheet falls by gravity onto a lower support surface for partial support thereby after exiting from the exit corrugation rollers with the remainder of the support of each sheet being by an output tray.

The number of sheets in each stack may be the same or different. Stapling may occur with some stacks of sheets but not others.

While each sheet falls in substantially the same predetermined location on the support surface or a top sheet supported on the support surface, they do not fall at exactly the same position. However, each sheet usually falls within a predetermined range in both its longitudinal and lateral directions.

Accordingly, each sheet must be quickly aligned with the other stacked sheets that are to be stapled together. Thus, it is desired to have a sheet aligning device capable of moving each sheet to a predetermined location.

This alignment must be accomplished in a very short period of time since a sheet moving device of the sheet aligning mechanism must complete alignment of the sheet before the next sheet arrives at the support surface. This time depends on the feed rate of the printed sheets but can be as small as one second, for example. Otherwise, the next sheet cannot fall within the predetermined range because of the presence of the sheet moving device of the sheet aligning mechanism.

Furthermore, a relatively complex sheet moving device must be employed if it is not disposed very close to the sheet on the support surface. However, if the sheet moving device is positioned in its home position very close to the sheet when it is disposed on the support surface, the sheet moving device of the sheet aligning mechanism must be moved out of the way before the next sheet falls towards the support surface by gravity and engagement of the sheet by a sheet engaging member of a bail actuator also falling by gravity.

An example of a previously suggested sheet aligning mechanism is shown and described in the aforesaid Ardery et al application, Ser. No. 09/793,360. It utilizes two fingers as the frictional moving member with each moving the sheet at a different portion of each cycle of operation.

SUMMARY OF THE INVENTION

The present invention uses a single frictional member to align a sheet at a predetermined location, which is a corner defined by two substantially perpendicular reference barriers although the two reference barriers do not have to intersect. Each of these two reference barriers is spaced a distance within a predetermined range from the position of an adjacent edge of the sheet supported by a lower support surface to which each sheet falls by gravity. One of the reference barriers is further from the adjacent edge of the sheet than the other reference barrier is from the edge of the sheet adjacent thereto when the sheet is disposed for support by the lower support surface after falling thereon by gravity.

The present invention uses a single aligning roller for having frictional contact with each sheet received by the support surface, which is preferably an upper surface of an accumulator table. The aligning roller continuously exerts a force on the sheet when it is in frictional contact with the sheet.

The aligning roller is aligned relative to each of the two substantially perpendicular reference barriers so that more of its force is applied to move the sheet toward the reference barrier spaced further from the adjacent edge of the sheet. This is accomplished by placing the aligning roller at angle greater than 45° to the reference barrier spaced furthest from the adjacent edge of the sheet.

The direction of rotation of driving means, which rotates the aligning roller, is selected so that the force of the driving means tends to lift the aligning roller from the sheet being advanced. This limits the maximum alignment force on the sheet when the roller is subjected to a high resistive force from the sheet engaging a barrier or a load. This lifting action on the aligning roller reduces the normal force between the aligning roller and the sheet to decrease the alignment force, which is the product of the normal force and the coefficient of friction between the roller and the sheet, until a torque equilibrium state is reached.

An object of this invention is to provide a finisher having a single aligning roller for moving a sheet into engagement with two substantially perpendicular reference barriers, which define a corner, spaced different distances from adjacent edges of the sheet.

A further object of this invention is to provide a finisher in which aligned sheets in a stack can be stapled to each other.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
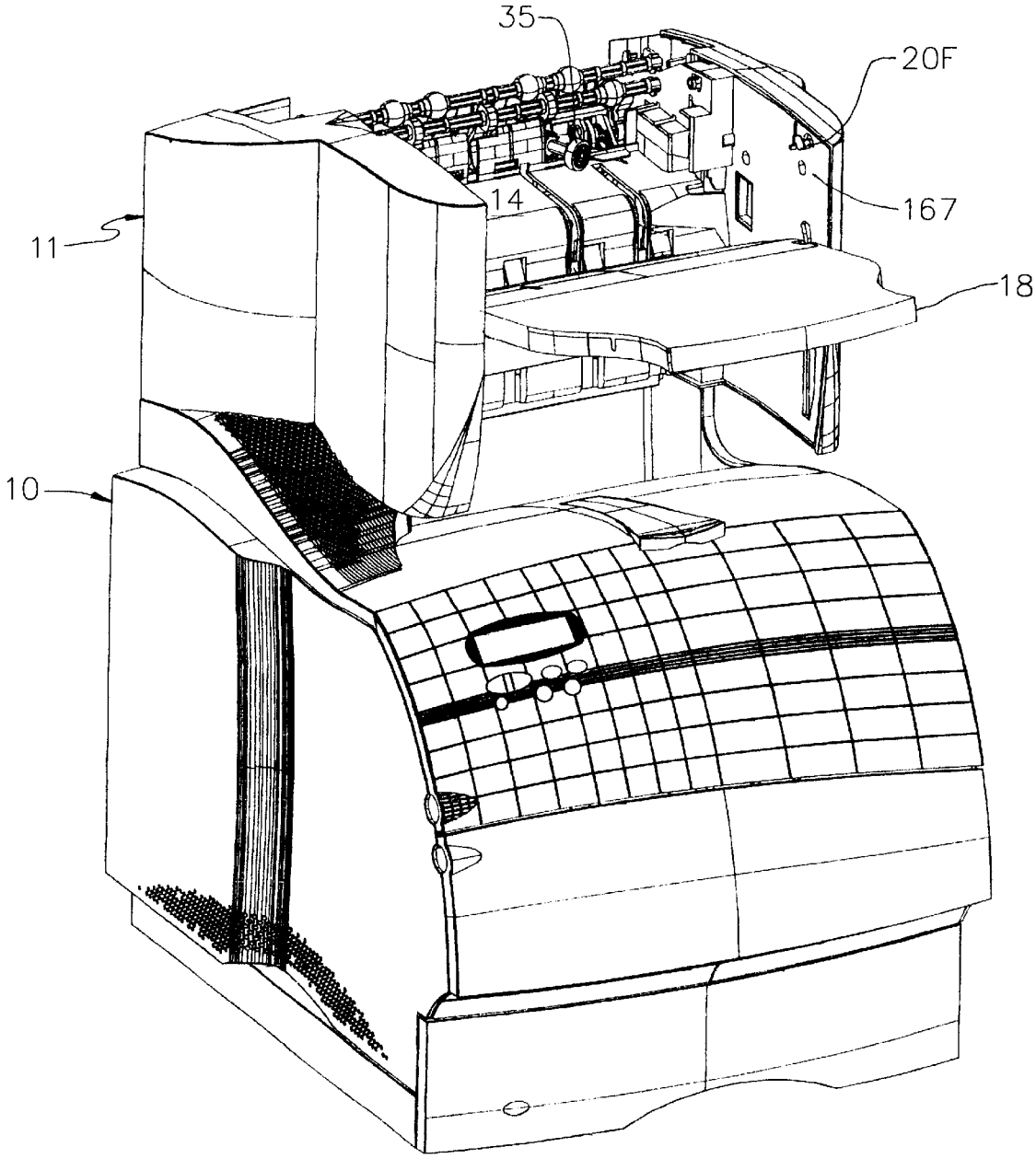
FIG. 1 is a front perspective view of a printer having a finisher of the present invention disposed thereon.

Referring to the drawings and particularly FIG. 1, there is shown a printer 10 having a finisher 11, which can be detachable from the printer 10 and is supported thereby. One suitable example of the printer 10 is a laser printer sold under the trademark OPTRA by the assignee of this application or as modified in the future.

When the finisher 11 is releasably attached to the printer 10, printed sheets 12 (see FIG. 2) are fed in sequence from the rear of the printer 10 (see FIG. 1) vertically into the rear of the finisher 11. This may be in a known manner such as described in U.S. Pat. No. 5,810,353 to Baskette et al, for example.

Figure 2:
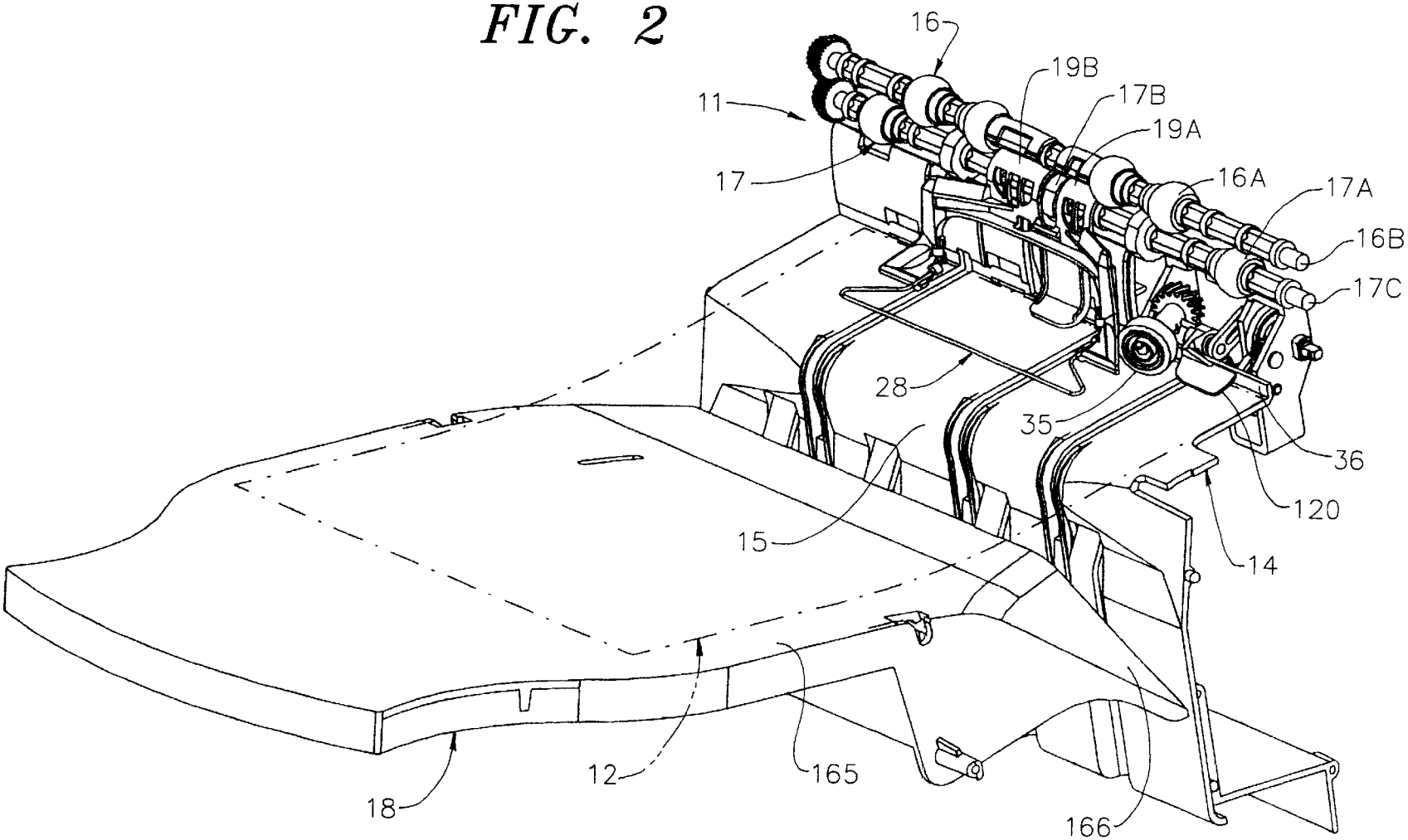
FIG. 2 is a right side perspective view of the finisher of FIG. 1 including an aligning roller, an accumulator table receiving sheets falling by gravity for support thereby during advancement by the aligning roller towards two substantially perpendicular reference barriers, and an inclined output tray to which each sheet (shown in phantom) is advanced after being aligned with the two reference barriers by the aligning roller.
Figure 3:
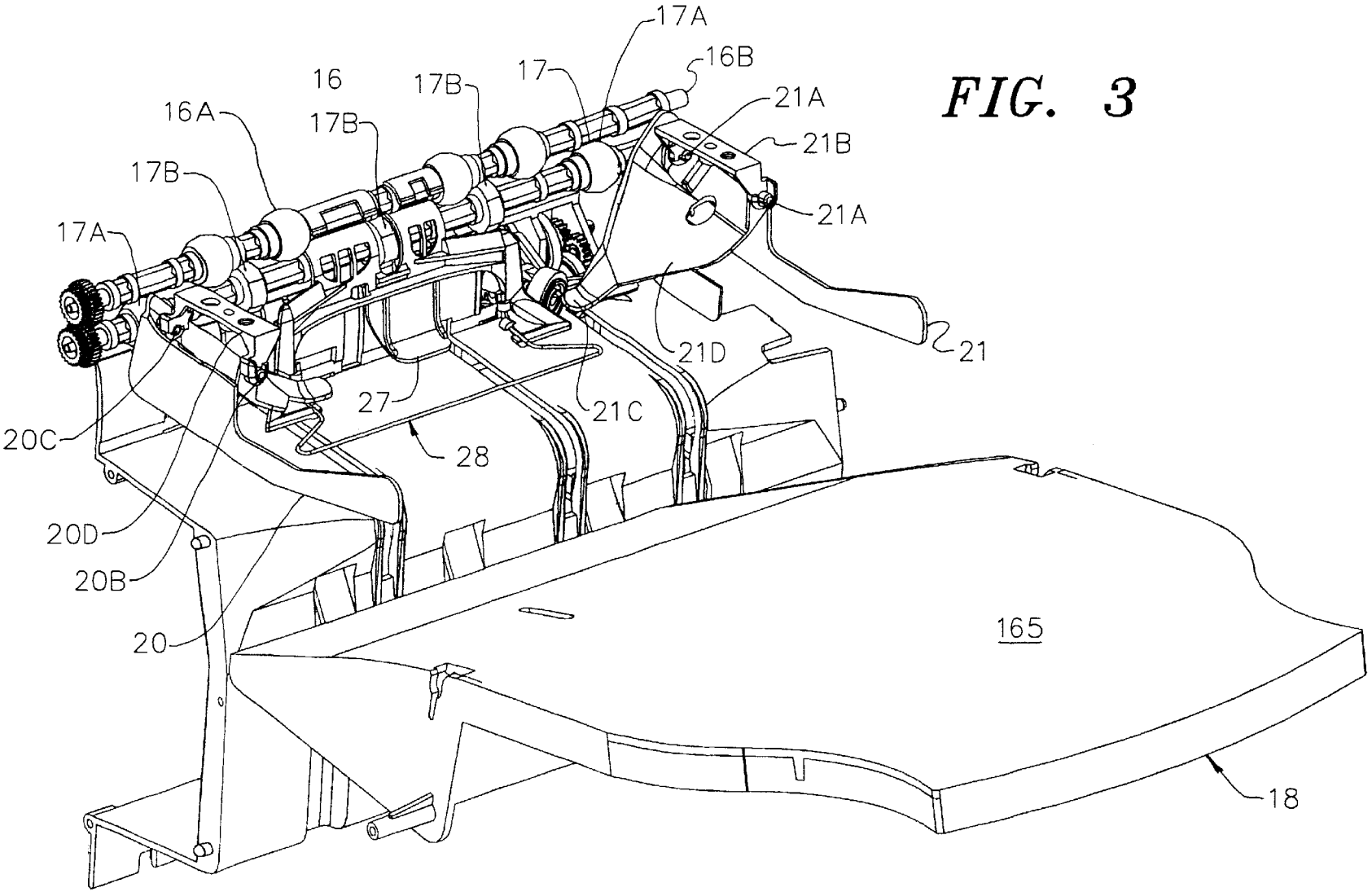
FIG. 3 is a left side perspective view of the finisher of FIG. 2 with left and right bails added thereto.

The finisher 11 includes an accumulator table 14 (see FIG. 2) having an upper support surface 15 to which each of the printed sheets 12 is fed by an upper cooperating set 16 (see FIG. 3) of four exit corrugation rollers 16A mounted on a shaft 16B and a lower cooperating set 17 of two large corrugation rollers 17A and three small corrugation rollers 17B mounted on a shaft 17C (see FIG. 2). The axial spacing of the four exit corrugation rollers 16A (see FIG. 3) on the shaft 16B relative to the two large corrugation rollers 17A and the three small corrugation rollers 17B of the set 17 is particularly shown and described in the aforesaid Ardery et al application, Ser. No. 09/793,360, which is incorporated by reference herein.

Thus, the corrugation rollers 16A and the corrugation rollers 17A and 17B cooperate to induce wave shapes across each of the printed sheets 12 (see FIG. 2) exiting therefrom but only while the printed sheets 12 are engaged by the rollers 16A, 17A, and 17B. After each of the printed sheets 12 exits the two sets 16 and 17 of the exit corrugation rollers 16A, 17A, and 17B, each of the printed sheets 12 falls onto the upper support surface 15 of the accumulator table 14 for support thereby or on top of another of the printed sheets 12 already supported by the upper support surface 15 of the accumulator table 14. The printed sheet 12 falls by gravity and the engaging force of a pivot actuator 19 (see FIG. 21) also falling by gravity.

As each of the printed sheets 12 (see FIG. 2) falls onto the upper support surface 15 of the accumulator table 14, most of each of the printed sheets 12 will be supported on an inclined output tray 18. The inclined output tray 18 is spring mounted to be continuously urged upwardly to maintain the vertical separation between the upper support surface 15 of the accumulator table 14 and the topmost sheet 12 supported on the inclined output tray 18 as the printed sheets 12 are disposed on it.

The bail actuator 19 (see FIG. 21) has a pair of arcuate extensions 19A and 19B pivotally mounted on the shaft 16B (see FIG. 22) of the upper set 16 of the exit corrugation rollers 16A. As each of the printed sheets 12 exits from between the corrugation roller sets 16 and 17, its leading edge 19C engages a back surface 19D of each of the arcuate extensions 19A and 19B (see FIG. 21) in a portion not wrapped around the shaft 16B. This exerts a force on the bail actuator 19 to cause the bail actuator 19 to move from its rest or home position of FIG. 22 to its position in FIG. 23 through the bail actuator 19 pivoting 20° about the axis of the shaft 16B.

Figure 23:
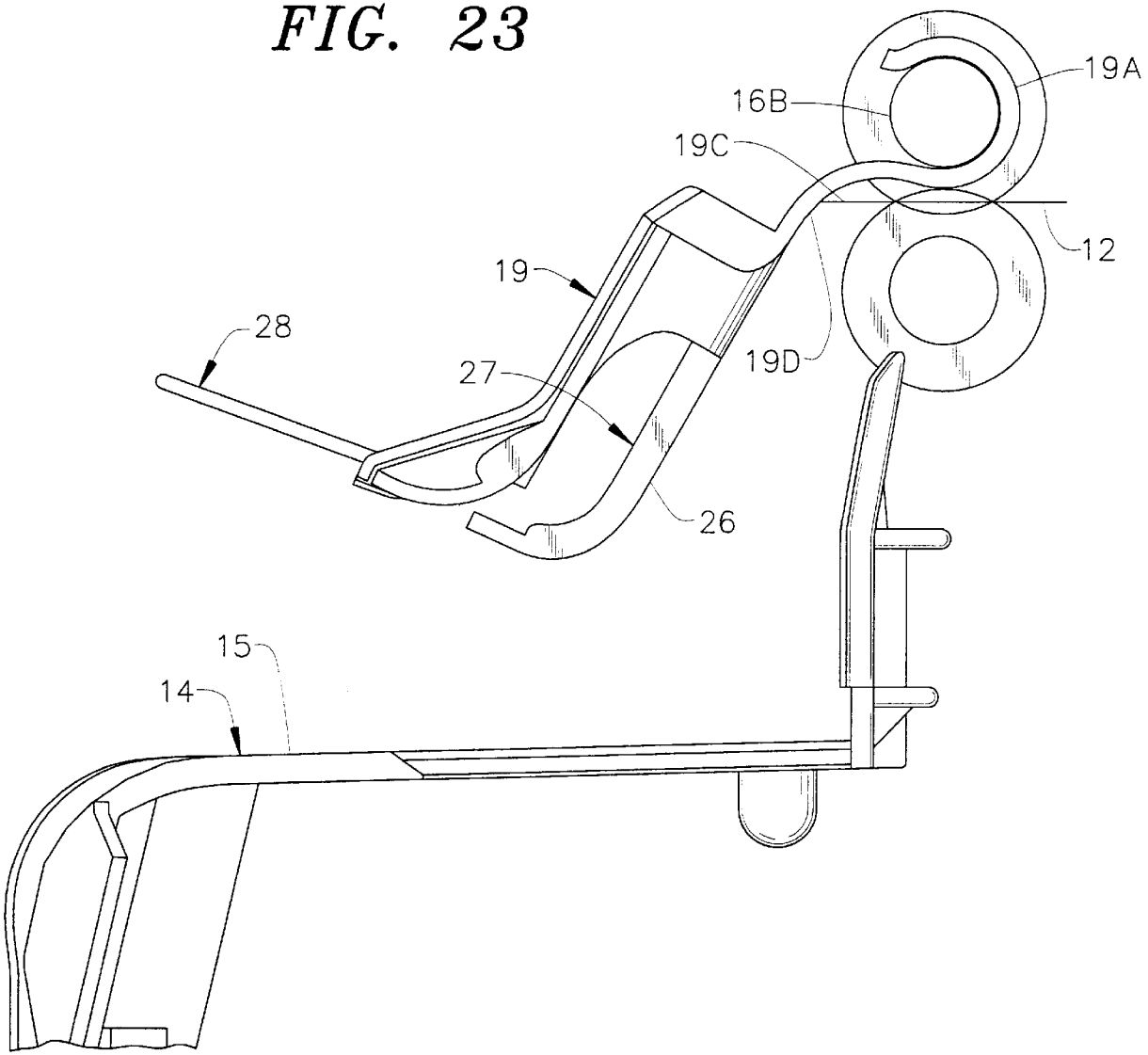
FIG. 23 is a side schematic view, similar to FIG. 22, with the bail actuator pivoted 20° from its position of FIG. 22.
Figure 25:
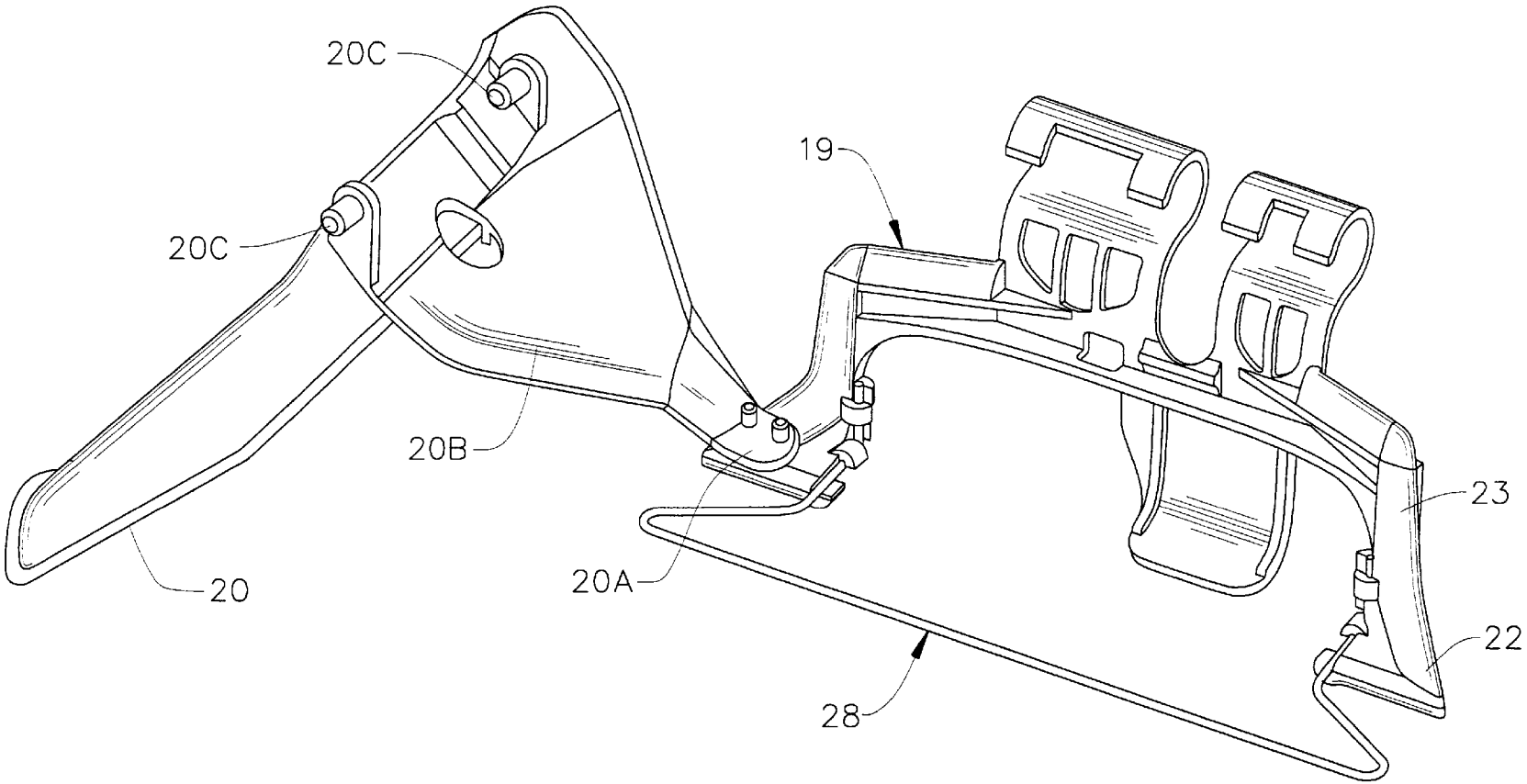
FIG. 25 is a perspective view showing the relation between the left bail and the bail actuator when the bail actuator has pivoted to its position of FIG. 23.

When the bail actuator 19 is in the position of FIG. 23, a cam surface 19E (see FIG. 21) at the bottom of a leg 19F of the bail actuator 19 causes pivotal movement of a left bail 20 (see FIG. 25) through the cam surface 19E engaging a cam surface (not shown) on the bottom surface of a bottom portion 20A of an actuation arm 20B of the left bail 20. The left bail 20 is pivotally mounted through two pivot pins 20C being supported in a mounting bracket 20D (see FIG. 3), which is attached to a top cover (not shown) supported on a side frame 20F (one shown in FIG. 1) of the finisher 11. This is more particularly shown and described in the aforesaid Gordon et al application, Ser. No. 09/779,852, which is incorporated by reference herein.

A right bail 21 (see FIG. 3) is similarly pivotally mounted by two pivot pins 21A being supported in a mounting bracket 21B, which also is attached to the top cover (not shown) supported on the side frame (one shown at 20F in FIG. 1) of the finisher 11. The right bail 21 has a cam surface (not shown) on the bottom surface of a bottom portion 21C (see FIG. 3) of an actuating arm 21D engaged by a cam surface 22 (see FIG. 21) at the bottom of a leg 23 of the bail actuator 19 for movement at the same time as the left bail 20 (see FIG. 3). Therefore, the bails 20 and 21 cooperate to support the printed sheet 12 (see FIG. 24) in the manner more particularly shown and described in the aforesaid Gordon et al application, Ser. No. 09/779,852.

Figure 24:
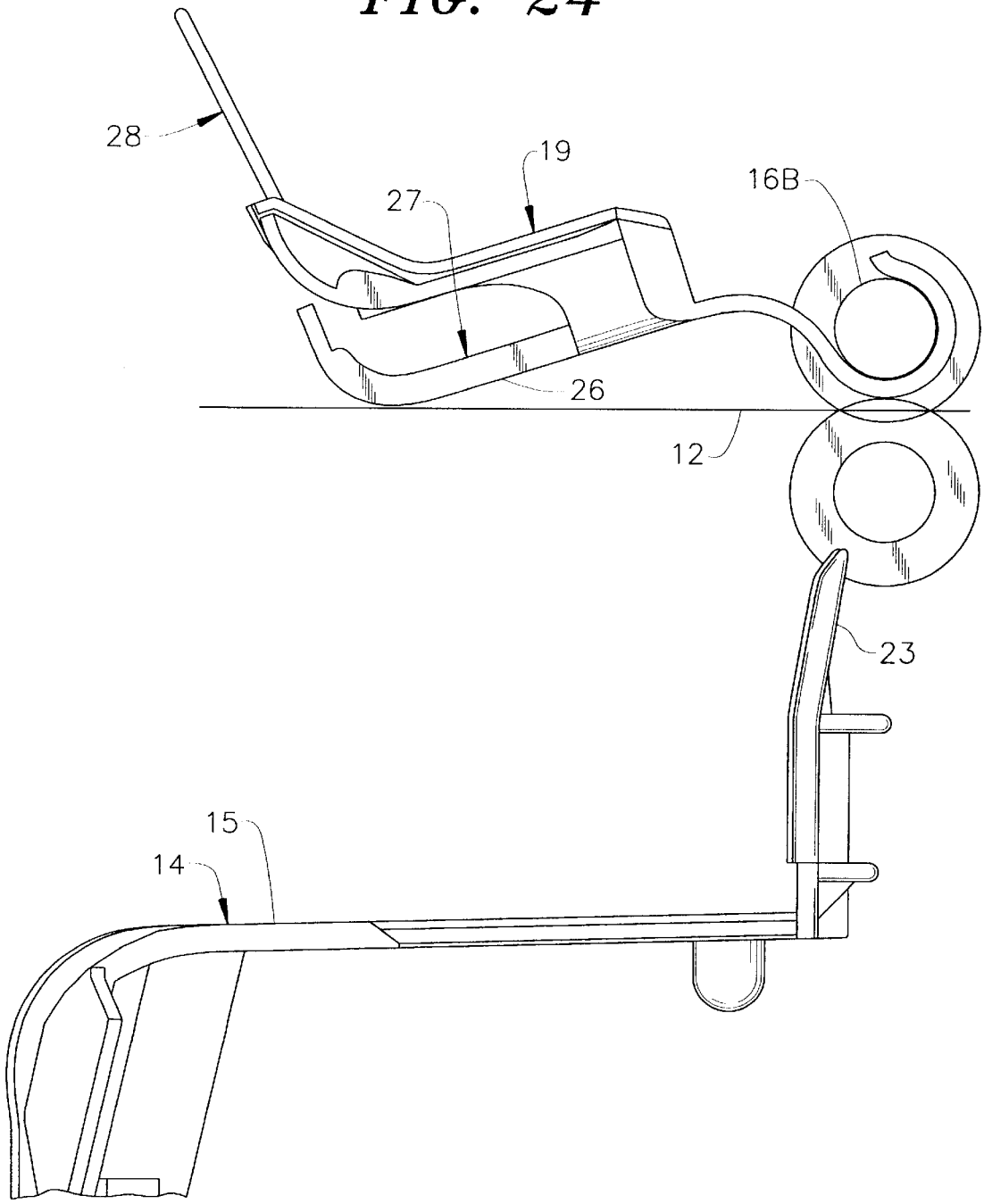
FIG. 24 is a side schematic view, similar to FIGS. 22 and 23, with the bail actuator at its maximum pivoted position prior to the sheet falling by gravity as it leaves the exit corrugation rollers.

The leading edge 19C (see FIG. 23) of the printed sheet 12 advances from the position of FIG. 23 until the bail actuator 19 reaches its maximum pivoted position of FIG. 24. The leading edge 19C (see FIG. 22) of the printed sheet 12 rode along the back surface 19D of each of the arcuate extensions 19A (see FIG. 21) and 19B until it reached a main portion 25 of the bail actuator 19. Thereafter, the leading edge 19C (see FIG. 23) of the printed sheet 12 rode along a back surface 26 of a sheet engaging member 27, which extends downwardly from the main portion 25 (see FIG. 21) of the bail actuator 19.

After reaching the position of FIG. 24 and rear edge 37 (see FIG. 4) of each of the printed sheets 12 exits the corrugation rollers 16A (see FIG. 2), 17A and 17B, the bail actuator 19 (see FIG. 24) begins to fall by gravity to cause pivoting of the bail actuator 19 about the axis of the shaft 16B so that the printed sheet 12 is removed from support by the bails 20 (see FIG. 3) and 21. This results in the bails 20 and 21 also pivoting downwardly by gravity due to the bail actuator 19 (see FIG. 21) pivoting downwardly by gravity.

The sheet engaging member 27 (see FIG. 24) of the bail actuator 19 pushes downwardly on the printed sheet 12. This causes the printed sheet 12 to fall by gravity to the upper support surface 15 of the accumulator table 14 and the inclined output tray 18 (see FIG. 2).

Figure 21:
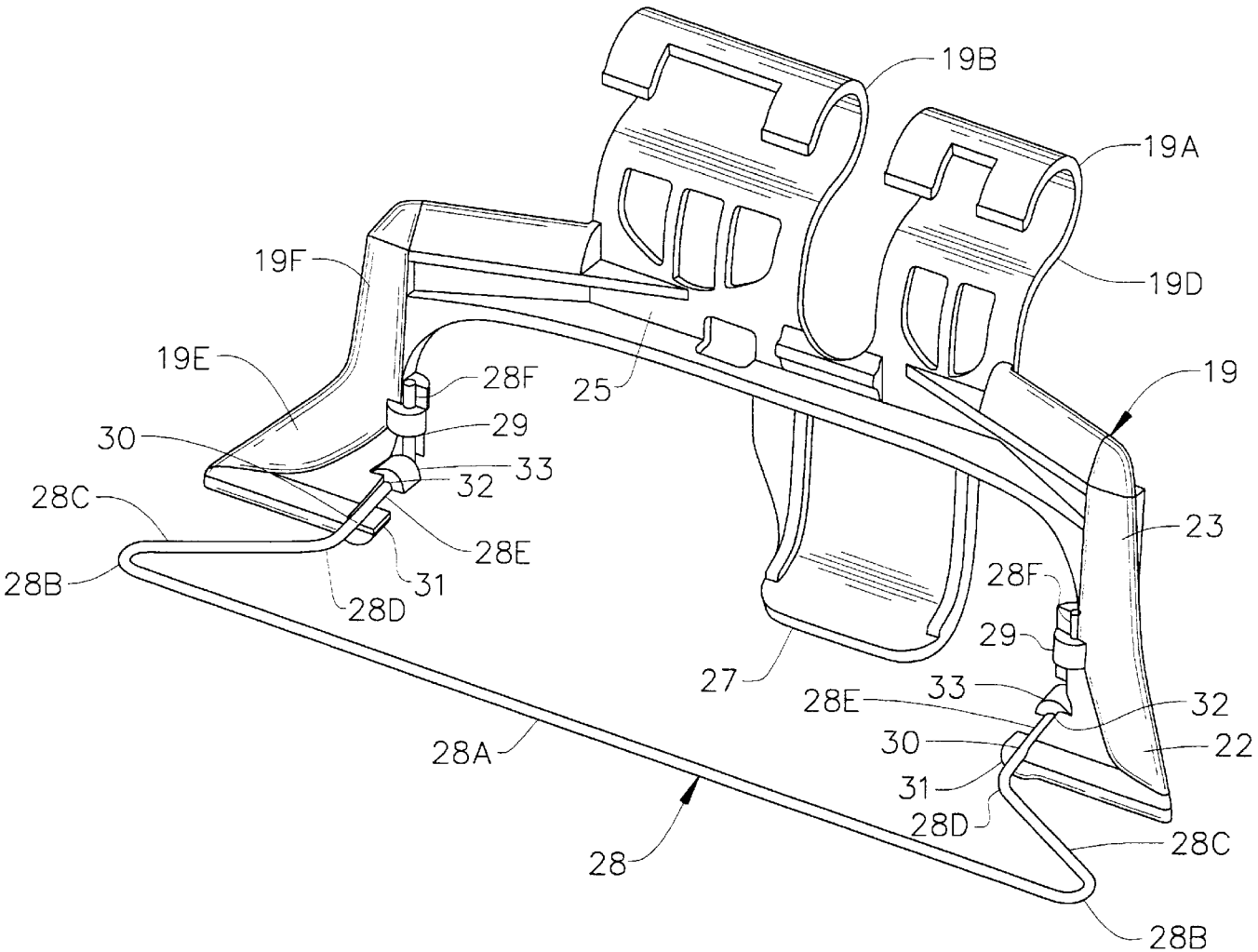
FIG. 21 is a perspective view of the bail actuator used in the finisher of the present invention.
Figure 22:
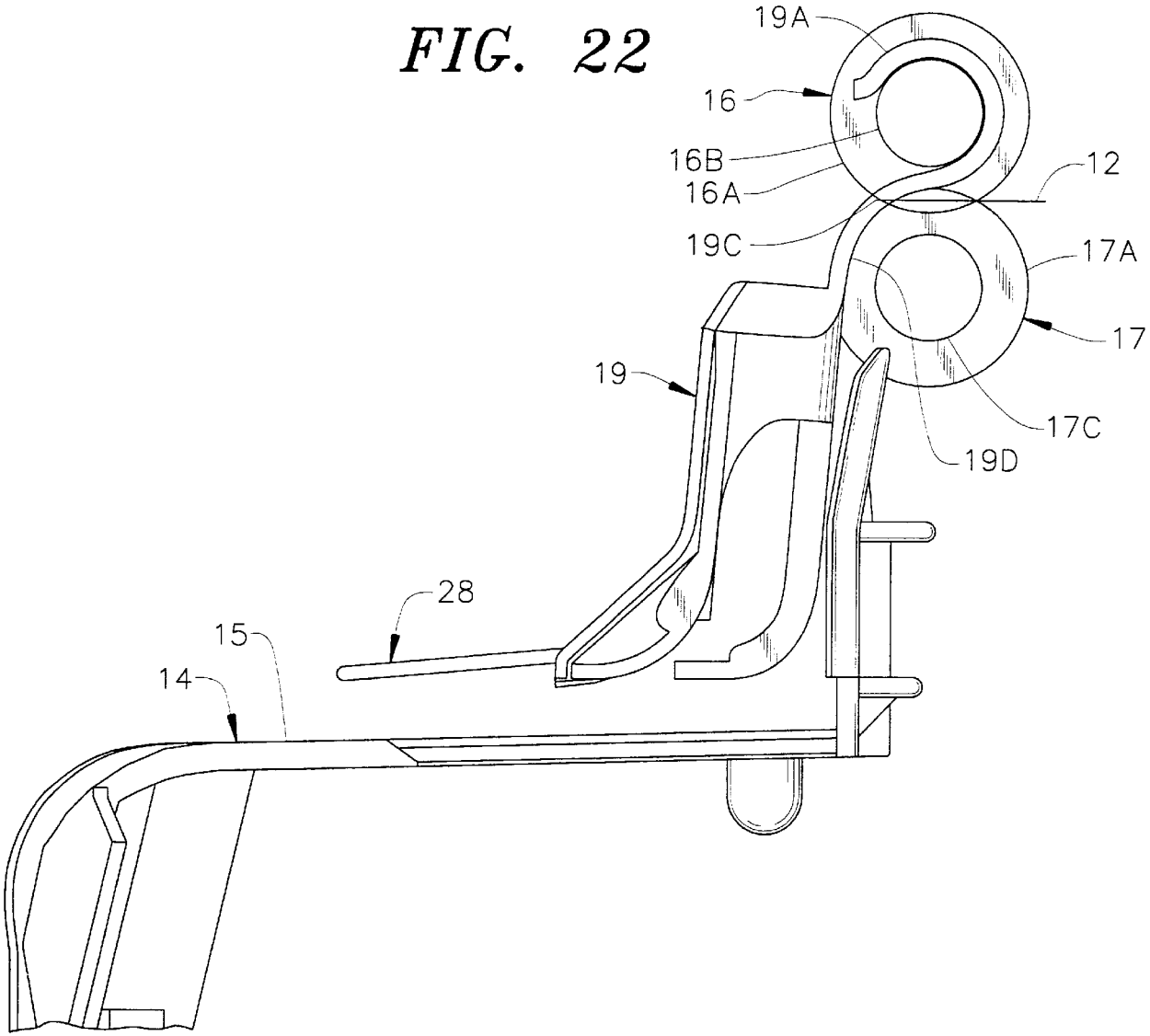
FIG. 22 is a side schematic view of a bail actuator in its rest or home position with a sheet beginning to exit from two sets of exit corrugation rollers.

As the bail actuator 19 (see FIG. 24) falls downwardly by gravity, a wire bail 28 engages the printed sheet 12. As shown in FIG. 21, the wire bail 28 includes a horizontal front portion 28A having a curved horizontal portion 28B at each end connected to an angled horizontal portion 28C. Each of the angled horizontal portions 28C is connected by a curved horizontal portion 28D to a rear horizontal portion 28E. Each of the rear horizontal portions 28E terminates in a vertical end portion 28F extending upwardly therefrom.

Each of the vertical end portions 28F is disposed in a retainer 29 mounted on each of the legs 19F and 23 of the bail actuator 19. This prevents horizontal movement of the wire bail 28.

The rear horizontal portion 28E has a snap fit in a groove 30 in an extension 31 of each of the legs 19F and 23 of the bail actuator 19 to prevent downward movement of the wire bail 28. The rear horizontal portion 28E also has a snap fit in a groove 32 in a retainer 33 on the extension 31 of each of the legs 19F and 23 of the bail actuator 19 to prevent upward movement of the wire bail 28.

The horizontal front portion 28A of the wire bail 28 preferably has a length of about five inches. It is desired that the horizontal front portion 28A of the wire bail 28 extend as wide as possible.

The horizontal front portion 28A of the wire bail 28 breaks any longitudinal beam created in the printed sheet 12 (see FIG. 24) because of a curl created in the printed sheet 12 by a fuser (not shown) of the printer 10 (see FIG. 1), for example. This occurs after the printed sheet 12 (see FIG. 24) falls by gravity and is supported on the upper support surface 15 of the accumulator table 14.

This is because the fuser (not shown) of the printer 10 creates a longitudinally extending curl in the printed sheet 12 to form the beam or arch along the entire length of the printed sheet 12 with a downwardly facing arch. The horizontal front portion 28A (see FIG. 21) of the wire bail 28 breaks the longitudinal beam, if it exists, in the printed sheet 12 (see FIG. 24) after it is supported on the upper support surface 15 of the accumulator table 14. The horizontal front portion 28A (see FIG. 21) of the wire bail 28 creates a beam in the direction of the width of the printed sheet 12 (see FIG. 24) with a desired upwardly facing arch configuration. This upwardly facing arch of the printed sheet 12 increases the beam strength of each of the printed sheets 12 in the direction of alignment in which each of the printed sheets 12 is moved.

Figure 26:
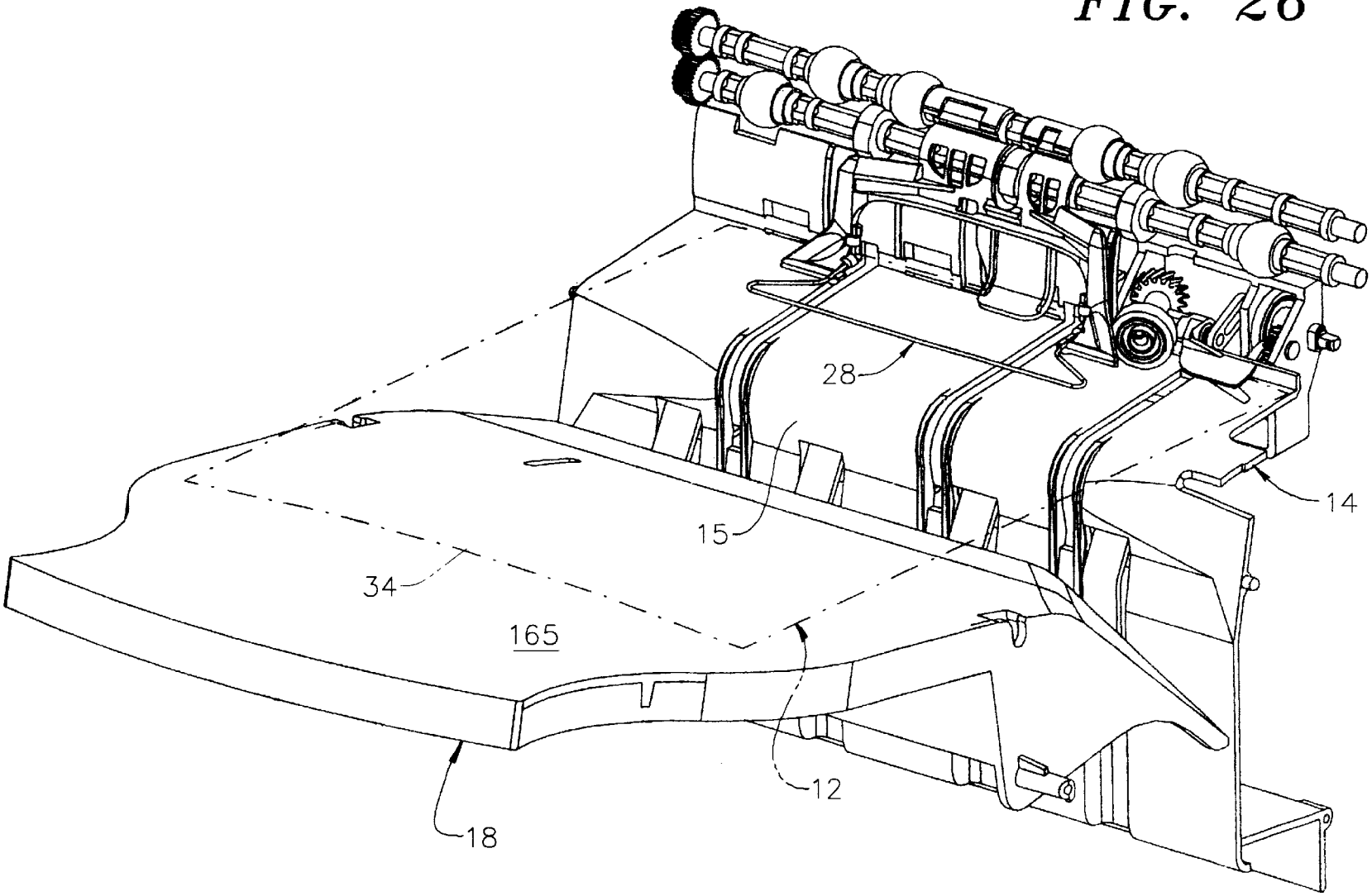
FIG. 26 is a right side perspective view that is the same as FIG. 2 except that a printed sheet is shown with a longitudinal downwardly facing arch extending the length of the sheet.
Figure 27:
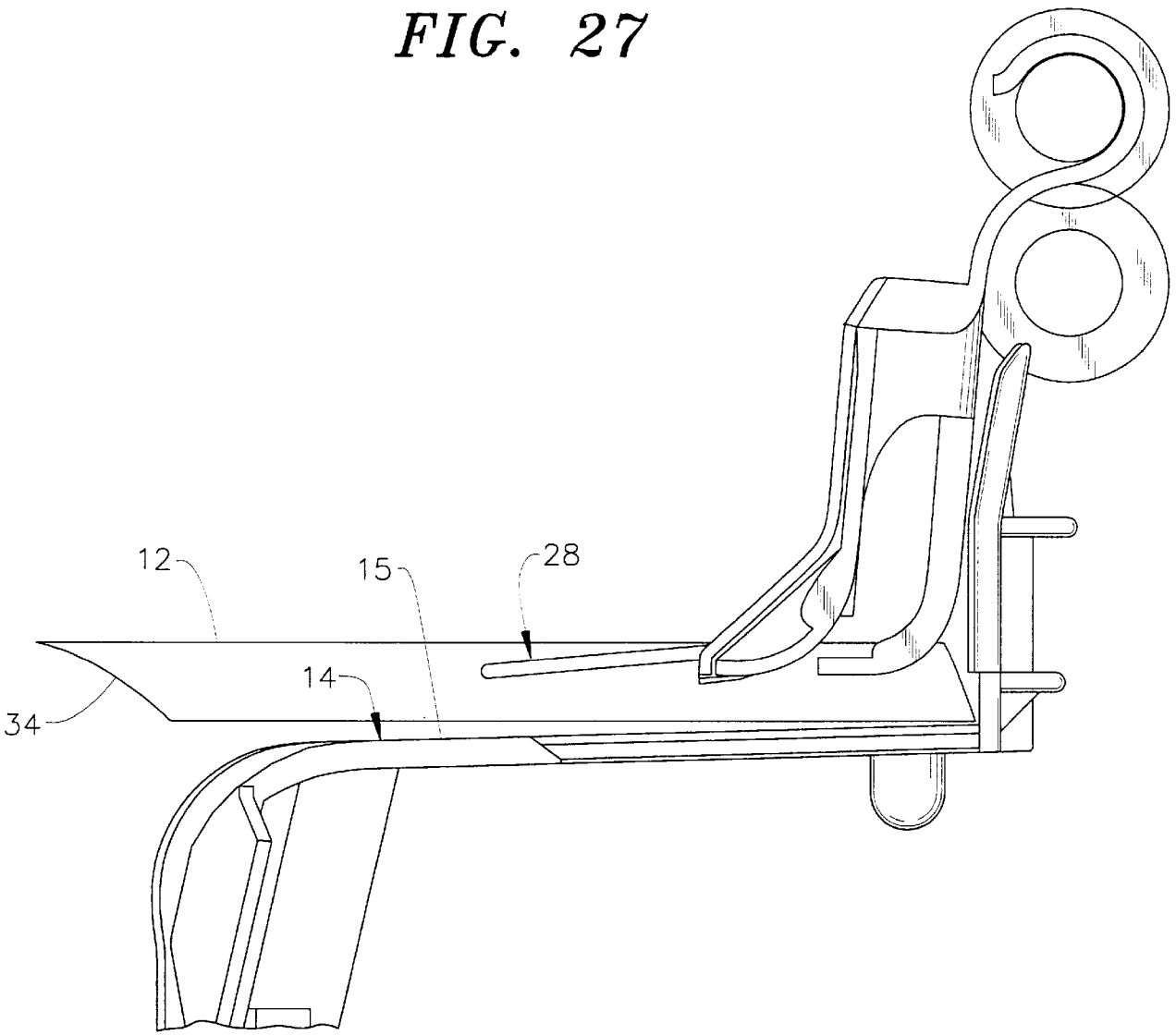
FIG. 27 is a side schematic view that is the same as FIG. 22 except that a printed sheet has a longitudinal downwardly facing arch extending the length of the sheet.

The downwardly facing arch in the printed sheet 12 is shown in FIG. 26 at 34 and is larger than shown. It also is shown in FIG. 27. FIG. 26 also shows the printed sheet 12 not falling by gravity in the desired shape because of the longitudinal beam in the printed sheet 12.

Figure 12:
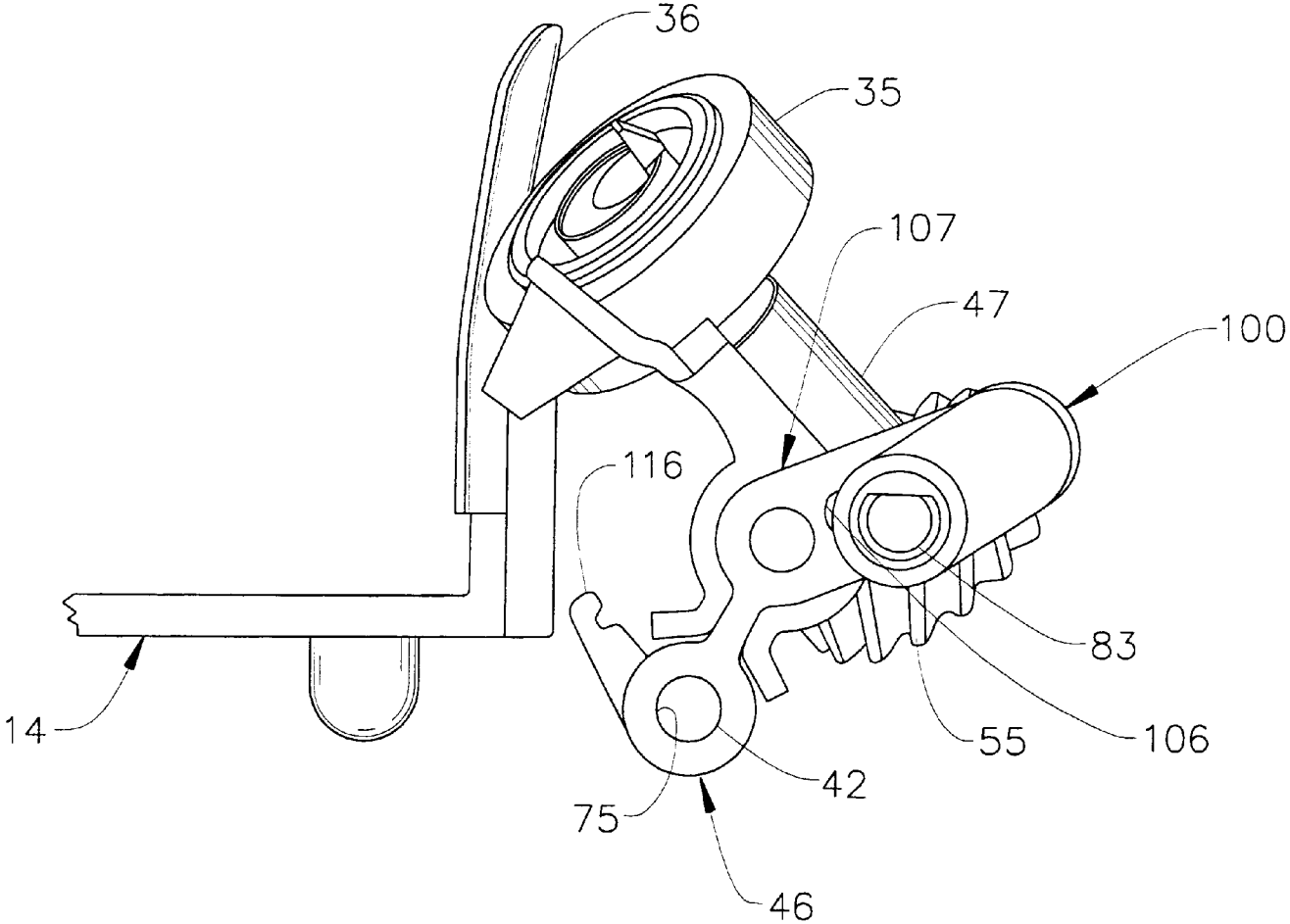
FIG. 12 is a fragmentary side elevation view of the aligning roller in its home or rest position in which the aligning roller does not rotate, a portion of the accumulator table on which each printed sheet is supported, and a driving crank.

When each of the printed sheets 12 (see FIG. 2) falls by gravity onto the upper support surface 15 of the accumulator table 14, an aligning roller 35 must be maintained in an elevated position, which is its home position of FIG. 12, to enable the printed sheet 12 (see FIG. 2) to fall by gravity onto the accumulator table 14. The aligning roller 35 is shown in FIG. 2 in its frictional contact position with the printed sheet 12 to be advanced by the aligning roller 35.

The accumulator table 14 includes a rear wall 36, which is substantially perpendicular to the upper support surface 15. The rear wall 36 functions as a rear reference barrier for engagement by the rear edge 37 (see FIG. 4) of each of the printed sheets 12.

The rear edge 37 of the printed sheet 12 must be within 10 mm. of the rear wall 36 (see FIG. 2) of the accumulator table 14. There is preferably only 4 mm. between the rear edge 37 (see FIG. 4) of the printed sheet 12 and the rear wall 36 of the accumulator table 14 (see FIG. 2). If the spacing is greater than 10 mm., the aligning roller 35 cannot advance the printed sheet 12 in the manner shown in FIGS. 4–6.

Figure 10:
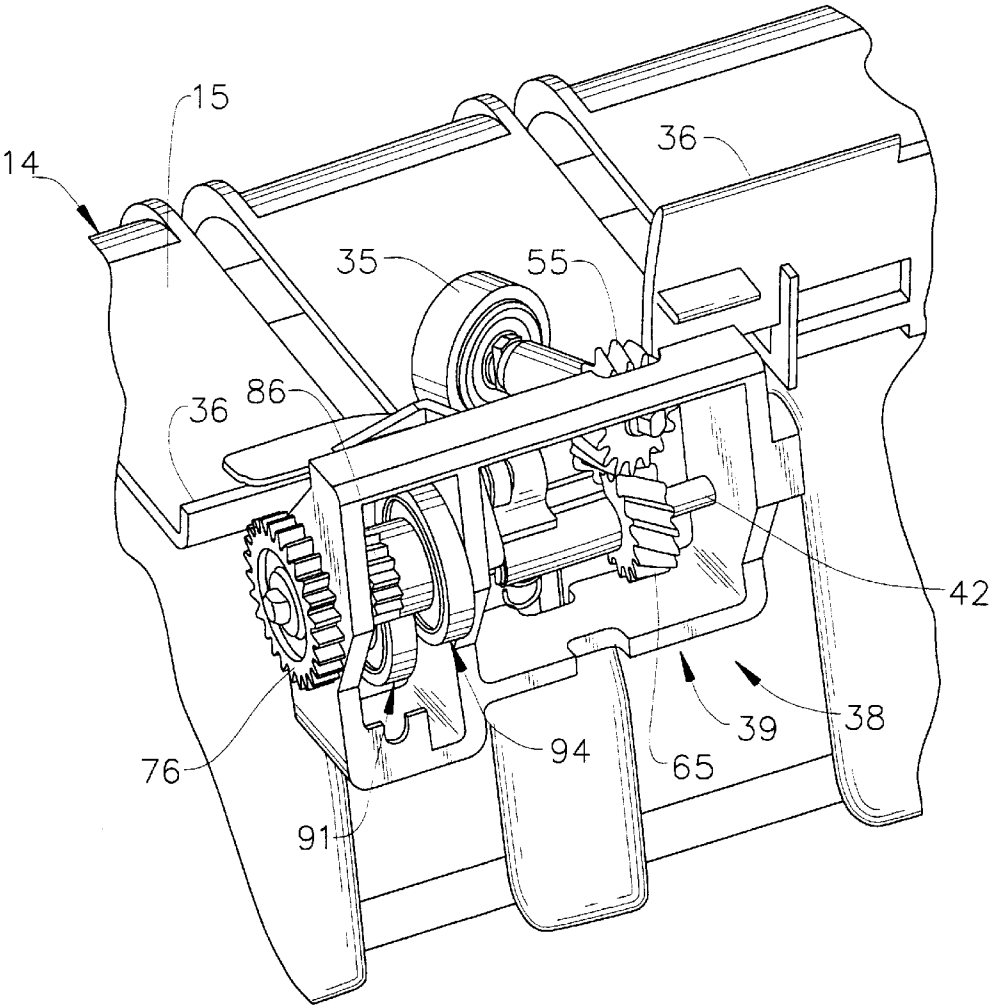
FIG. 10 is a rear perspective view of a portion of the finisher of FIG. 7 showing the sheet aligning assembly of FIG. 7 disposed relative to the accumulator table of the finisher.
Figure 13:
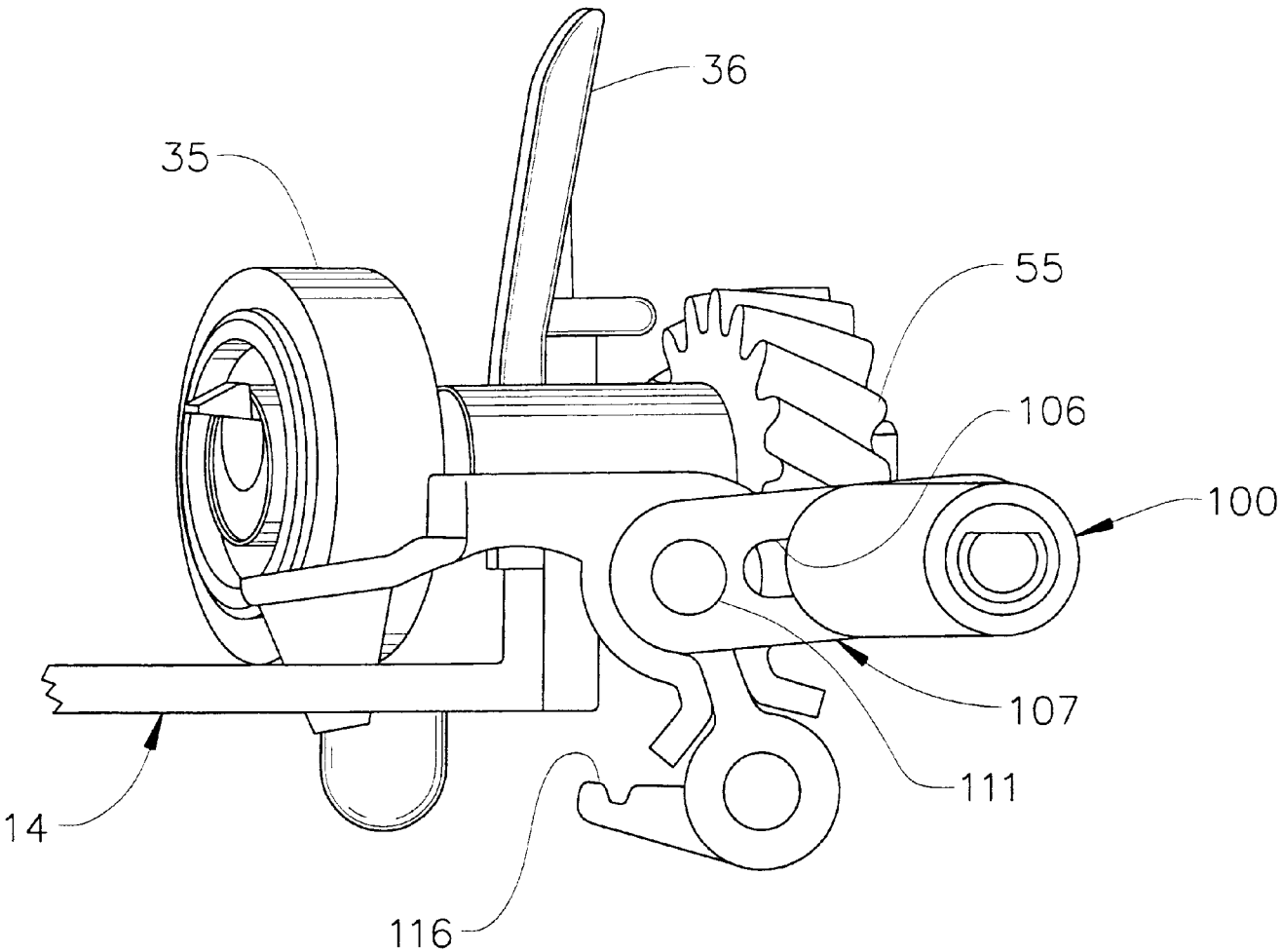
FIG. 13 is a fragmentary side elevation view, similar to FIG. 12, of the aligning roller in its frictional contact position with a printed sheet for advancing the printed sheet to its aligned position, the portion of the accumulator table, and the driving crank advanced 180° from its home position of FIG. 12.
Figure 14:
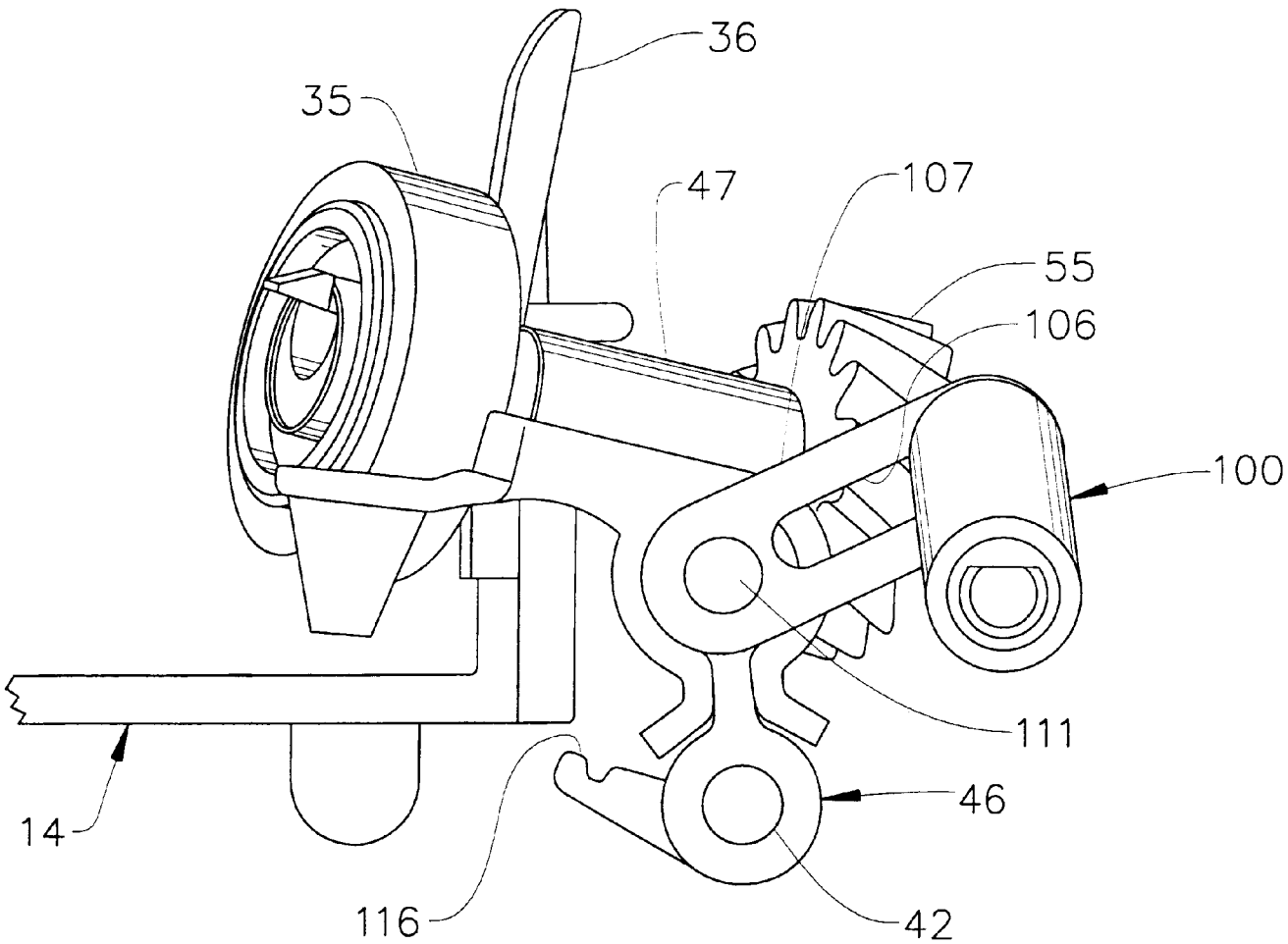
FIG. 14 is a fragmentary side elevation view, similar to FIG. 13, of the aligning roller, the portion of the accumulator table with the aligning roller removed from its sheet contact position in FIG. 13, and the driving crank advanced 90° from its position in FIG. 13 but 90° prior to its position in FIG. 12.
Figure 15:
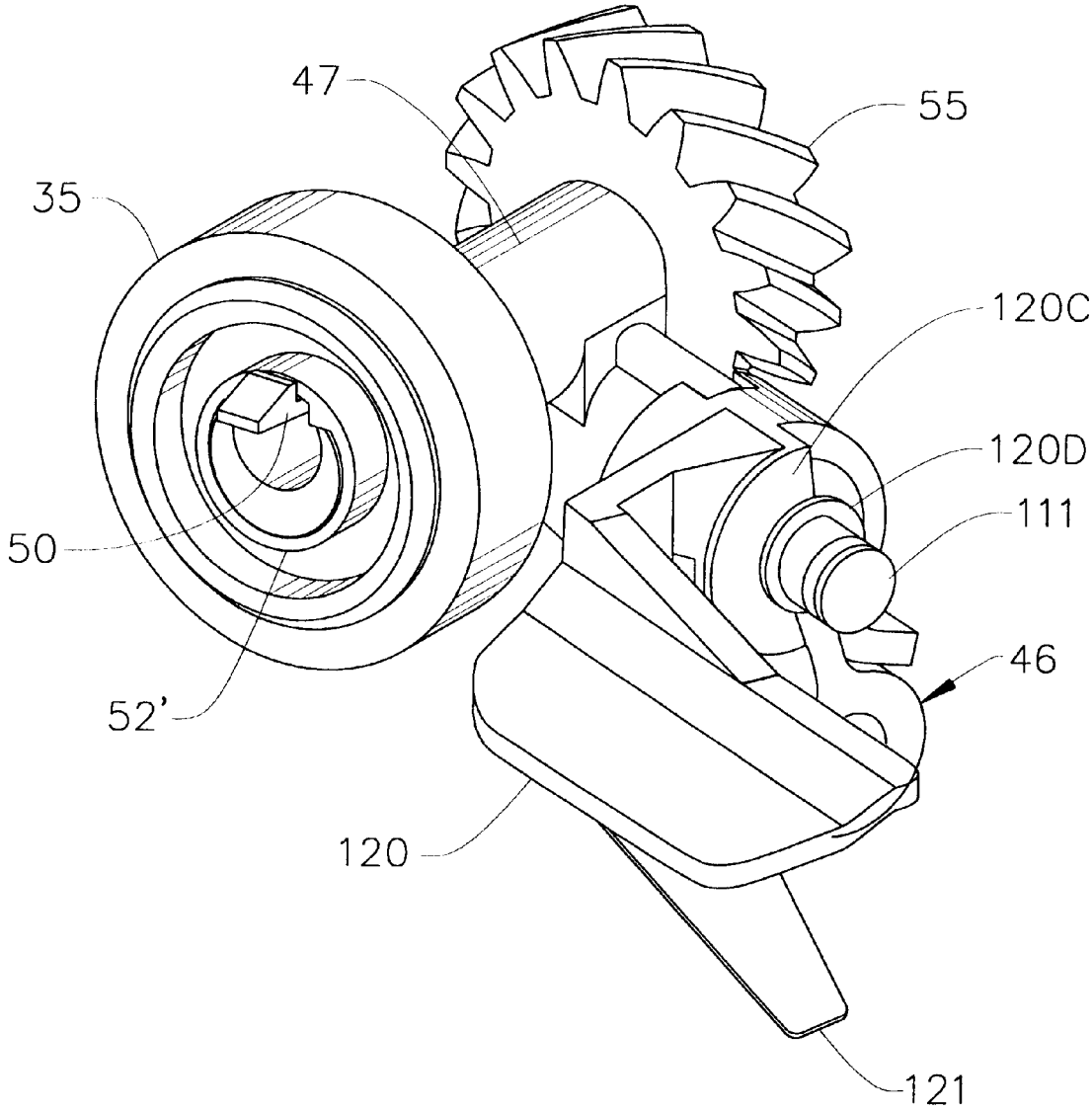
FIG. 15 is a perspective view of a sub-assembly of the aligning roller and its support.
Figure 16:
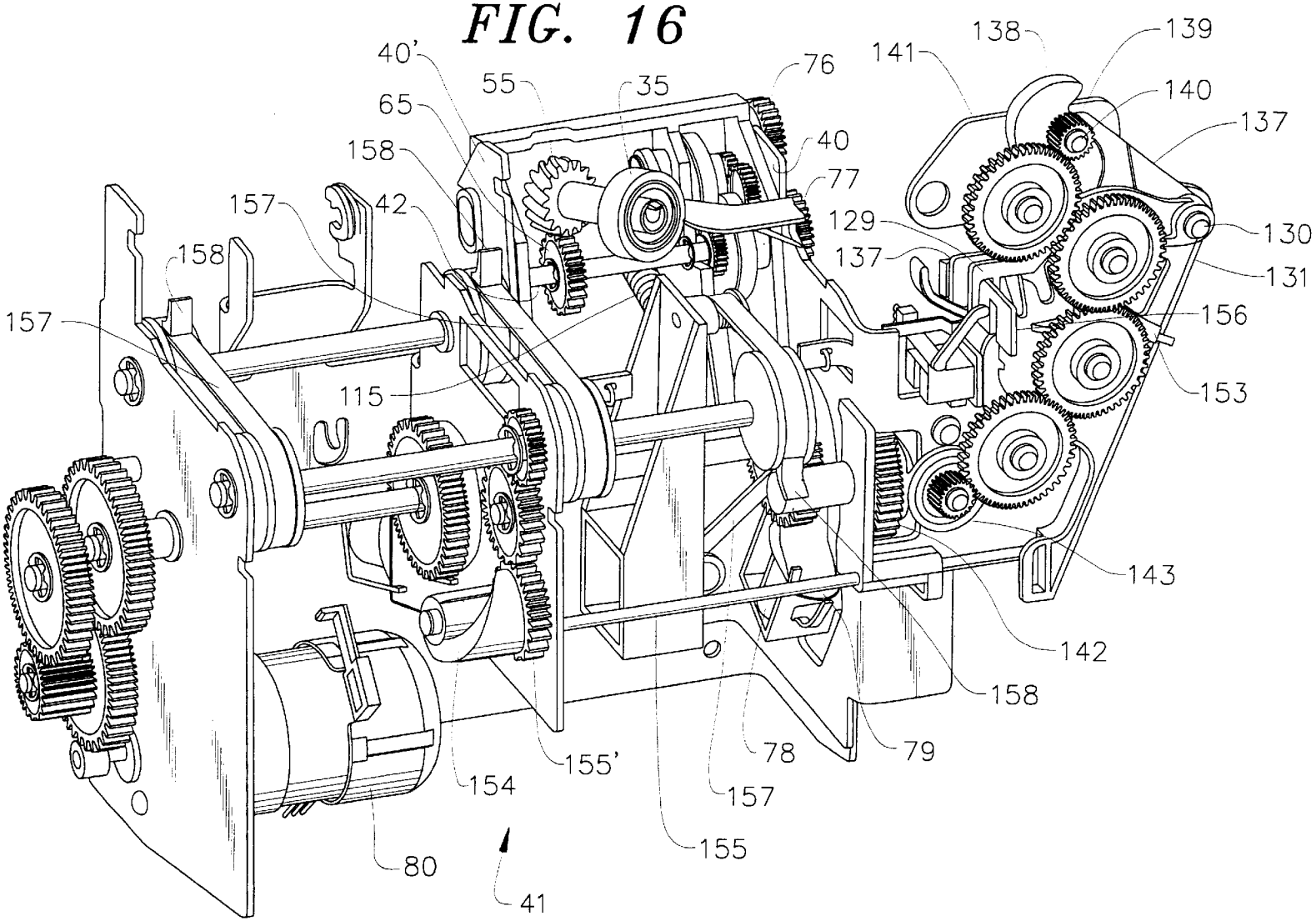
FIG. 16 is a front perspective view of a gear box of the finisher including a gear train for driving various portions of the finisher during each cycle of operation.

The aligning roller 35 is supported by a sheet aligning assembly 38 (see FIG. 7) for movement from its home position, which is shown in FIG. 12, to its frictional contact position, which is shown in FIG. 13, for engagement with each of the printed sheets 12 (see FIG. 4) and then returned to its home position. The sheet aligning assembly 38 (see FIG. 10) includes a frame 39, which is supported by walls 40 (see FIG. 16) and 40' of a gear box 41.

Figure 7:
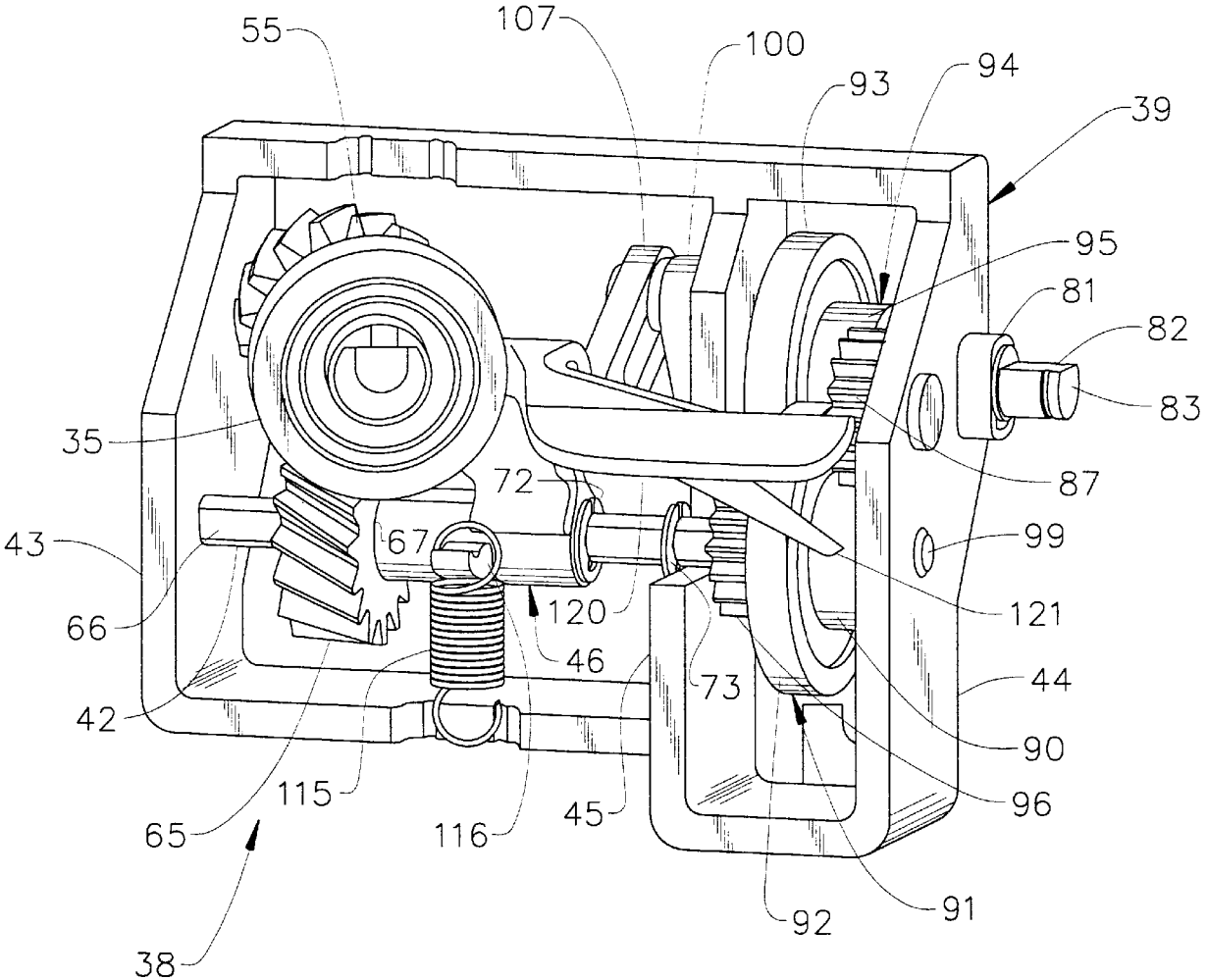
FIG. 7 is a perspective view of a sheet aligning assembly of the finisher.

As shown in FIG. 7, the frame 39 has a main shaft 42 rotatably supported in its end walls 43 and 44. The frame 39 has an intermediate wall 45 between the end walls 43 and 44.

Figure 9:
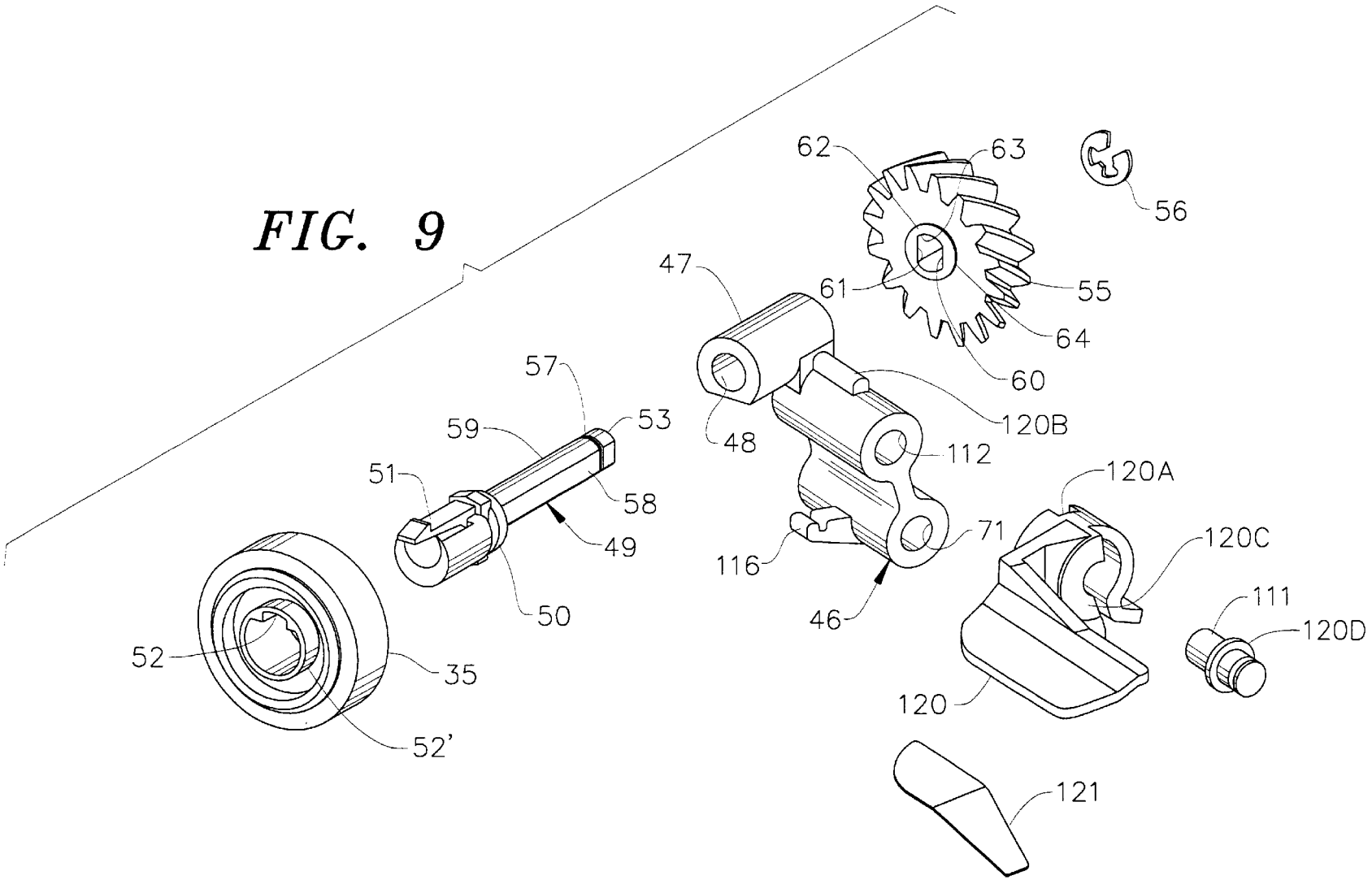
FIG. 9 is an exploded perspective view of a sub-assembly of the sheet aligning assembly of FIG. 8 including a pivotally mounted housing and the aligning roller supported by the pivotally mounted housing.

A housing 46 is mounted on the main shaft 42 for pivotal movement in both directions about the axis of the main shaft 42. The pivotally mounted housing 46 includes a cylindrical portion 47 (see FIG. 9) having a circular passage 48 extending therethrough.

A roller shaft 49 is rotatably supported in the circular passage 48 of the cylindrical portion 47 of the pivotally mounted housing 46. The roller shaft 49 has the aligning roller 35 retained on its enlarged end 50 by a resilient finger 51 disposed in a slot 52 in a hub 52' of the aligning roller 35 and engaging the hub 52'. This connection causes rotation of the aligning roller 35 only when the roller shaft 49 is rotated.

The roller shaft 49 has its other end 53 extending beyond the cylindrical portion 47 of the housing 46 to support a helical gear 55. The helical gear 55 is held on the roller shaft 49 (see FIG. 11) by a C-clip 56 disposed in a groove 57 (see FIG. 9) in the roller shaft 49.

The roller shaft 49 has flat side portions 58 and 59 against which flat side portions 60 and 61, respectively, of a circular passage 62 extending through the helical gear 55 engage. Accordingly, when the helical gear 55 is rotated, the roller shaft 49 rotates to rotate the aligning roller 35. Each side of the helical gear 55 has a boss 64 (one shown in FIG. 9) extending slightly beyond the remainder of each side of the helical gear 55.

Figure 8:
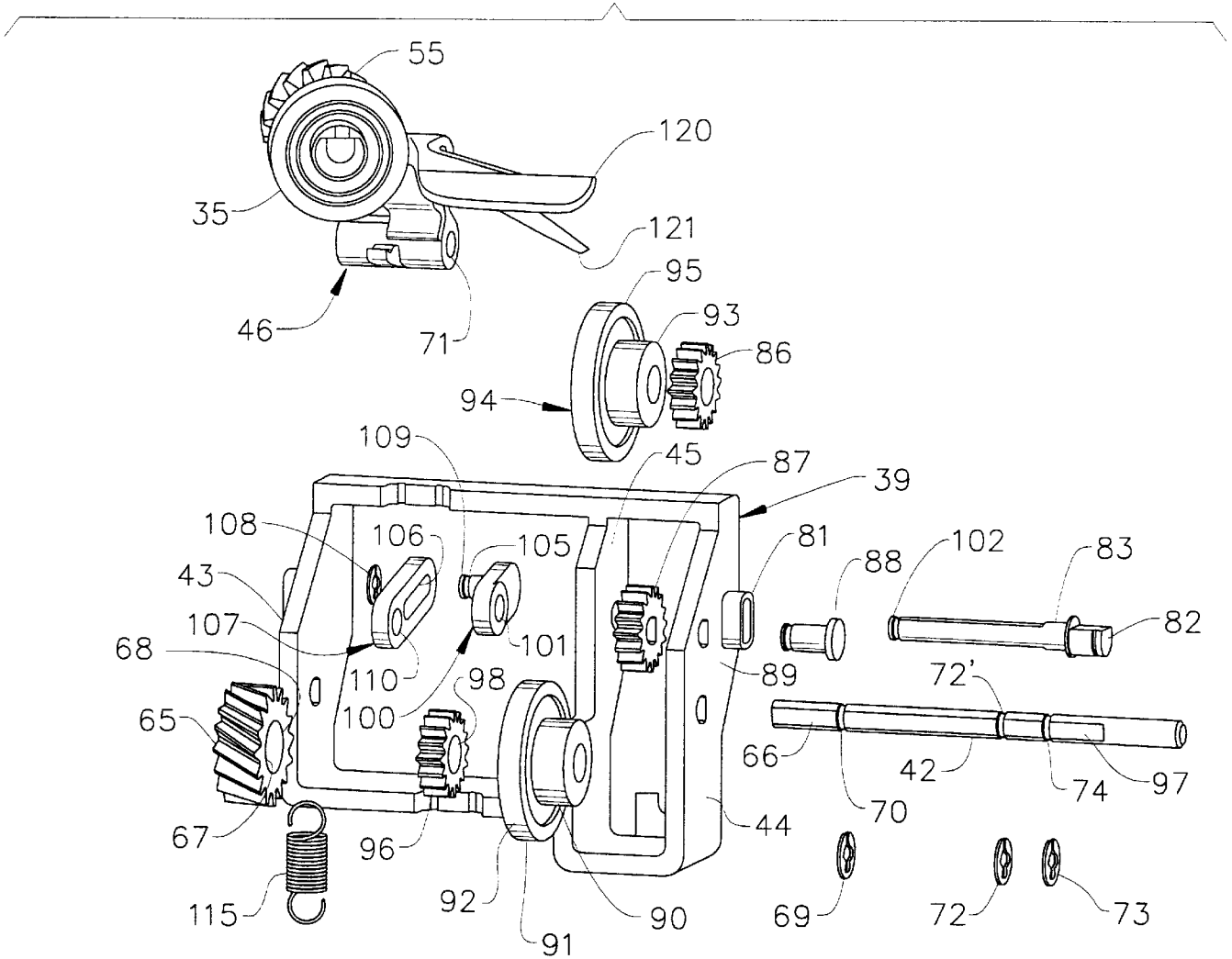
FIG. 8 is an exploded perspective view of the sheet aligning assembly of FIG. 7.

The helical gear 55 meshes with a helical gear 65 (see FIG. 7). The helical gear 65 is mounted on the main shaft 42 to be driven thereby. The helical gear 65 rotates with the main shaft 42 through flat side portions (one shown at 66 in FIGS. 7 and 8) on the main shaft 42 engaging cooperating flat side portions (not shown) of a circular passage 67 (see FIG. 8) in the helical gear 65. Each side of the helical gear 65 has a boss 68 (one shown in FIG. 8) extending slightly beyond the remainder of the helical gear 65.

A C-clip 69 is disposed in a groove 70 in the main shaft 42 to position the helical gear 65 on the main shaft 42 through limiting its axial movement to the left in FIG. 7. This insures that the teeth of the helical gear 65 and the teeth of the helical gear 55 will always mesh.

The pivotally mounted housing 46 (see FIG. 9) has a circular passage 71 to receive the main shaft 42 (see FIG. 7). This mounts the housing 46 on the main shaft 42 so that it may pivot in either direction on the main shaft 42.

The pivotally mounted housing 46 is disposed next to the helical gear 65 but slightly spaced therefrom because of the boss 68 (see FIG. 8) on the helical gear 65 engaging the adjacent side of the pivotally mounted housing 46 (see FIG. 7). A C-clip 72 (see FIG. 8) is disposed in a groove 72' in the main shaft 42 to hold the pivotally mounted housing 46 (see FIG. 7) on the main shaft 42 by limiting its axial movement to the right. Thus, the housing 46 is pivotally mounted on the main shaft 42 so that it can pivot relative to the main shaft 42 in either a clockwise or counterclockwise direction as the main shaft 42 is rotated in only one direction.

A C-clip 73 (see FIG. 8) is disposed in a groove 74 in the main shaft 42. The C-clip 73 engages the left (as viewed in FIG. 7) side of the intermediate wall 45 of the frame 39 to prevent movement of the main shaft 42 to the right.

The main shaft 42 is driven by a gear 76 (see FIGS. 10, 11, and 16) having its teeth mesh with teeth on a gear 77 (see FIG. 16) of a gear train in the gear box 41 of the finisher 11 (see FIG. 1). When an electromagnet 78 (see FIG. 16) of a clutch 79 is energized, a DC motor 80 causes rotation of the gear 76. This drives the main shaft 42 at a predetermined velocity during each cycle of operation.

A hollow projecting guide 81 (see FIG. 8) on the end wall 44 of the frame 39 is disposed within a corresponding shaped opening (not shown) in the wall 40 (see FIG. 16) of the gear box 41. This alignment insures that the gears 76 and 77 mesh satisfactorily.

The gear 76 (see FIG. 10) is mounted on a flattened end 82 (see FIG. 7) of a drive shaft 83 extending through the hollow projecting guide 81 on the exterior of the end wall 44 of the frame 39. The drive shaft 83 extends through the opening (not shown) in the wall 40 (see FIG. 16) of the gear box 41 to insure that the gear 76 is disposed within the gear box 41.

As shown in FIG. 7, the drive shaft 83 extends through a passage in the hollow projecting guide 81. The drive shaft 83 is rotatably supported in each of the end wall 44 and the intermediate wall 45 of the frame 39.

A drive gear 86 (see FIG. 8) is attached to the drive shaft 83. The drive gear 86 meshes with an idler gear 87.

The idler gear 87 is rotatably supported on a stub shaft 88, which extends through an opening 89 in the end wall 44 of the frame 39 to receive the idler gear 87. The idler gear 87 meshes with a smaller gear 90 of a compound gear 91.

The compound gear 91 is rotatably mounted on the main shaft 42. The compound gear 91 has its larger gear 92 mesh with a smaller gear 93 of a compound gear 94, which is rotatably mounted on the drive shaft 83.

The compound gear 94 has its larger gear 95 mesh with a drive gear 96, which is attached to the main shaft 42 for causing rotation thereof. Flat side portions 97 (one shown in FIG. 8) of the main shaft 42 cooperate with flat side portions (not shown) in a circular passage 98 in the drive gear 96.

The drive shaft 83 (see FIG. 8) has a crank 100 attached thereto through the drive shaft 83 being disposed in a hole 101 in the crank 100. The hole 101 is smaller at its end remote from the intermediate wall 45 of the housing 39 so that an end 102 of the drive shaft 83 engages this reduced portion of the hole 101 to have fixed engagement therewith.

The direct connection of the crank 100 to the drive shaft 83 results in the crank 100 rotating at a much slower velocity than the main shaft 42. The main shaft 42 makes approximately 3.75 revolutions per cycle of operation of the drive shaft 83, and the connected crank 100 rotates only one revolution per cycle of operation since the drive shaft 83 makes only one revolution per cycle of operation.

The crank 100 has a pin 105 formed integral therewith and extending through a longitudinal slot 106 in a link 107. A C-clip 108 is disposed in a groove 109 in the pin 105 of the crank 100 to maintain the pin 105 in sliding relation with the link slot 106. The link 107 has a circular passage 110 extending therethrough to receive a connecting pin 111 (see FIG. 9) extending through the circular passage 110 (see FIG. 8) into a circular passage 112 (see FIG. 9) in the housing 46 with which the connecting pin 111 has a press fit.

Rotation of the crank 100 (see FIG. 8) by the drive shaft 83 imparts pivotal motion to the housing 46 (see FIG. 7) during each cycle of operation. A spring 115 extends between a spring anchor 116 on the housing 46 and a portion (not shown) of the gear box 41 (see FIG. 16). This results in the spring 115 (see FIG. 7) continuously exerting a force on the pivotally mounted housing 46 so that a force is continuously exerted on the aligning roller 35 when it is in contact with the sheet 12 (see FIG. 11).

Thus, the spring 15 (see FIG. 7) continuously urges the pivotally mounted housing 46 away from the home position, as shown in FIG. 12, of the aligning roller 35 supported thereby. As a result, the force of the spring 15 (see FIG. 7) continuously causes the aligning roller 35 to exert a maximum normal force of a predetermined amount such as 50–60 grams, for example, on each of the printed sheets 12 (see FIG. 4) when the aligning roller 35 (see FIG. 7) comes in frictional contact therewith. This frictional contact position of the aligning roller 35 is shown in FIG. 13.

While the spring 115 (see FIG. 7) is the preferred force exerting means on the aligning roller 35, it should be understood that other suitable force exerting means such as a counterweight, for example may be employed, if desired. While the crank 100 (see FIG. 8) is preferred, it should be understood that a cam and a cam follower may be employed for controlling pivotal movement of the housing 46, if desired.

The housing 46 (see FIG. 9) also supports a deflector 120 for deflecting each of the printed sheets 12 (see FIG. 2) as each of the printed sheets 12 is aligned on the support surface 15 (see FIG. 2) of the accumulator table 14. This prevents each of the printed sheets 12 (see FIG. 11) from buckling upwardly when its side edge 123 engages an adjacent side reference barrier 122.

Additionally, a tongue 121 (see FIG. 9), which is preferably a polyester film sold under the trademark MYLAR, is adhered to the bottom of the deflector 120 by a suitable adhesive. The tongue 121, which preferably has a thickness of 0.004", rides on each of the printed sheets 12 (see FIG. 2) to prevent the printed sheet 12 from riding up the rear wall 36 of the accumulator table 14 during alignment.

The deflector 120 (see FIG. 9) has a slot 120A to receive a projection 120B on the housing 46 to prevent rotation of the deflector 120. A flange 120C on the deflector 120 engages the end of the housing 46 to limit movement of the deflector 120 onto the housing 46. A flange 120D on the connecting pin 111 engages the flange 120C on the deflector 120 when the connecting pin 111 has a press fit in the connecting pin 111.

The teeth of each of the helical gear 55 (see FIG. 7) and the helical gear 65 preferably have the same angle. However, there may be a slight difference between the angles of the teeth of the helical gear 55 and the helical gear 65, if desired.

Figure 11:
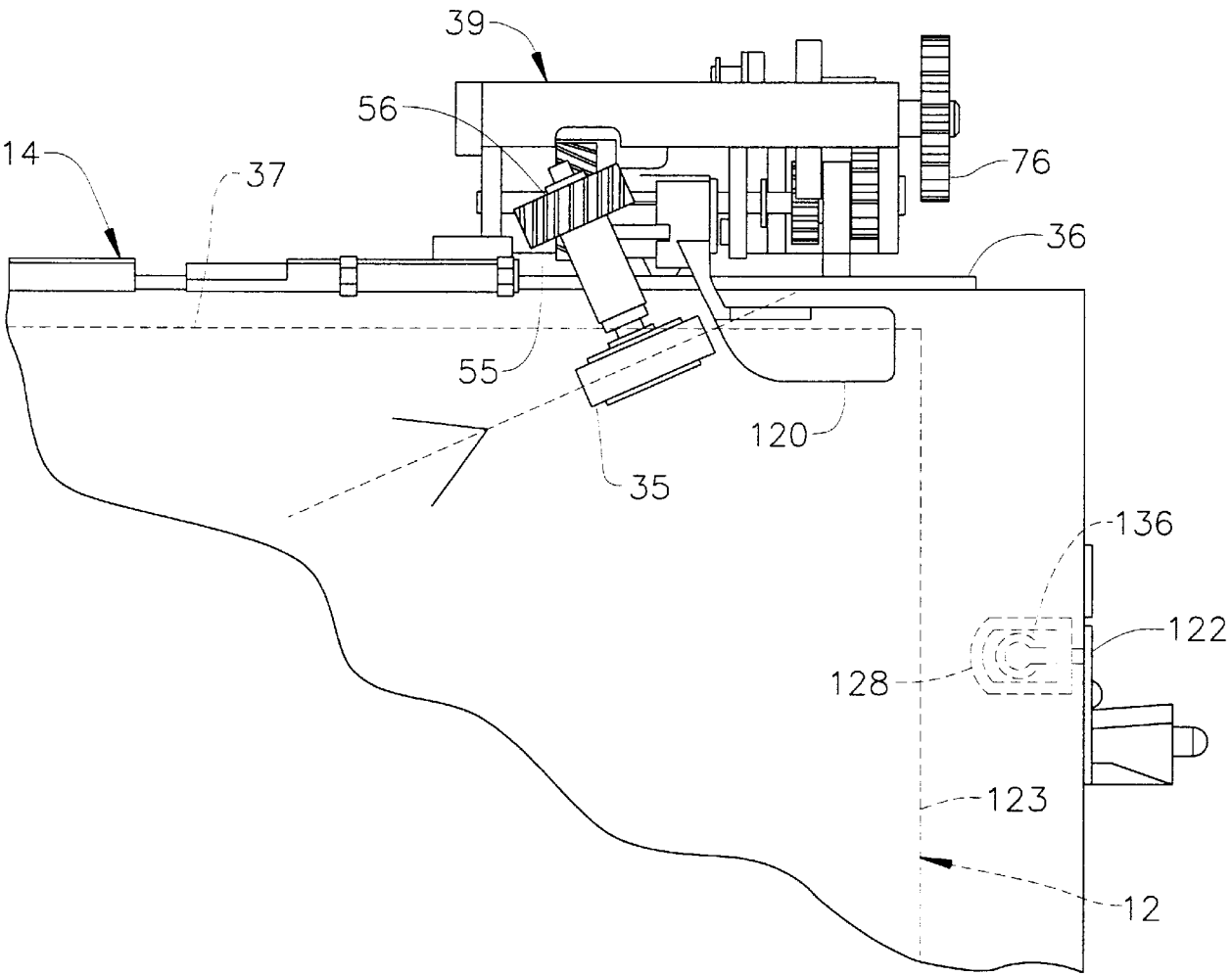
FIG. 11 is a fragmentary top plan view of the sheet aligning assembly of FIG. 7 along with a printed sheet in its initial position in dash lines and in its aligned position after completion of sheet advancement by the aligning roller in solid lines.

The sum of the angles of the teeth of the helical gear 55 and the helical gear 65 is equal to the angle of the aligning roller 35 relative to the side reference barrier 122 (see FIG. 11). The spacing between the side reference barrier 122 and the adjacent side edge 123 of the printed sheet 12 is typically 25 mm. and a maximum of 33 mm. for 8½×11 paper and typically 33 mm. and a maximum of 39 mm. for A4 paper.

With each of the helical gear 55 (see FIG. 7) and the helical gear 65 having their teeth at an angle of 33°, the sum of the angles is 66°. This also is the angle of the aligning roller 35 to the side reference barrier 122 (see FIG. 11) so that the angle of the aligning roller 35 (see FIG. 2) to the rear wall 36 of the accumulator table 14 is 24°.

While the angle of 66° is preferred, it should be understood that an angle in the range of 60° and 70° between the aligning roller 35 (see FIG. 11) and the side reference barrier 122 is satisfactory and other angles also could be employed, if desired. Furthermore, it should be understood that any angle greater than 45° of the aligning roller 35 with respect to the side reference barrier 122 will cause a greater force to be exerted on each of the printed sheets 12 to move it more towards the side reference barrier 122 than towards the rear wall 36.

Figure 5:
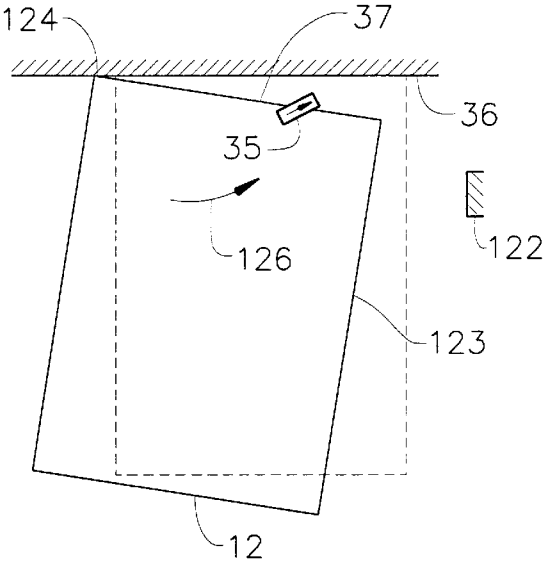
FIG. 5 is a schematic top plan view, similar to FIG. 4, showing advancement of the sheet from the final position of FIG. 4 (solid lines in FIG. 5) and engagement of a rear edge of the sheet with a rear reference barrier in dash lines.
Figure 4:
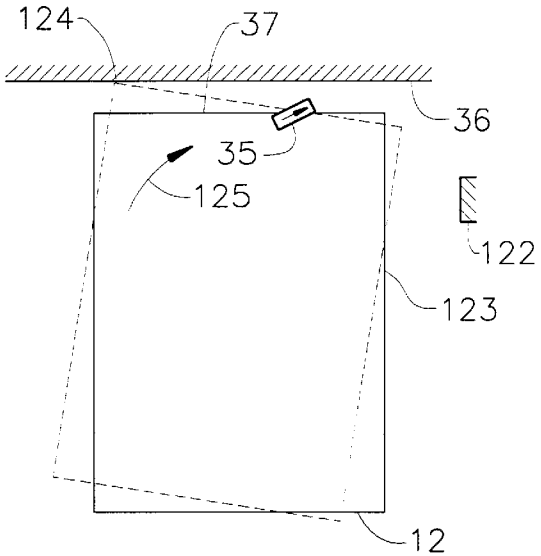
FIG. 4 is a schematic top plan view showing a sheet partially supported on the accumulator table after being fed thereto from exit corrugation rollers in solid lines and a dash line position to which the sheet is initially moved by the aligning roller.

As shown in FIG. 4, the aligning roller 35 initially rotates the printed sheet 12 clockwise from the solid line position until its corner 124 engages the rear wall 36 as shown in dash lines in FIG. 4 and in solid lines in FIG. 5. The clockwise rotation is indicated by an arrow 125.

The aligning roller 35 next advances the printed sheet 12 from the solid line position of FIG. 5 to the dash line position. This includes both counterclockwise rotation (as indicated by an arrow 126) and sliding motion of the printed sheet 12. At this time, the rear edge 37 of the printed sheet 12 has its entire surface engaging the rear wall 36.

Figure 6:
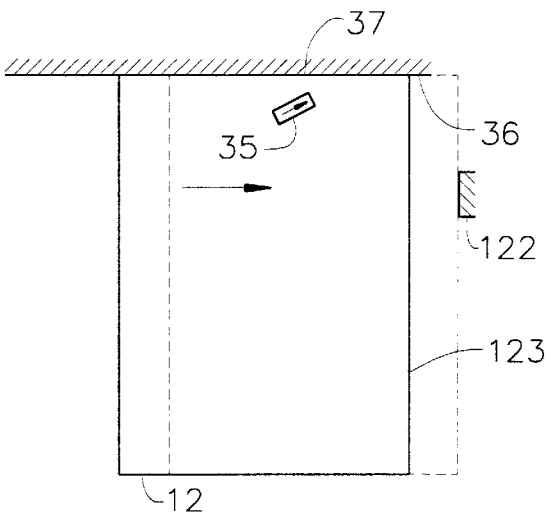
FIG. 6 is a schematic top plan view, similar to FIGS. 4 and 5, in which the solid line position is the position to which the sheet was advanced in FIG. 5 and the dash line position is at completion of advancement of the sheet with a side edge engaging a side reference barrier.

Then, the aligning roller 35 advances the printed sheet 12 from the solid line position of FIG. 6, which is the same as the dash line position of FIG. 5, until the side edge 123 of the printed sheet 12 engages the side reference barrier 122 as shown in dash lines in FIG. 6. At this time, the aligning roller 35 is removed from frictional contact with the printed sheet 12 by the pivotal motion of the housing 46 (see FIG. 7). During motion of the printed sheet 12 (see FIG. 6) only towards the side reference barrier 122, the rear edge 37 of the printed sheet 12 slides along the rear wall 36 with which it is in engagement so as to be in alignment therewith.

In FIG. 6, the side edge 123 of the printed sheet 12 is in engagement with the side reference barrier 122 so as to be in alignment therewith. As used in the claims, the term "alignment" of the rear edge 37 with the rear wall 36 or the side edge 123 of the printed sheet 12 with the side reference barrier 122 means that they are in engagement.

As the side edge 123 of the printed sheet 12 approaches the side reference barrier 122, it engages an angled side surface 127 (see FIG. 17) of a lower portion 128 of a pivotally mounted clamp arm 129. The clamp arm 129 is pivotally mounted on a pin 130 (see FIG. 16), which is fixed to a plate 141. A lever 131 also is pivotally mounted on the plate 141 of the gear box 41.

Figure 17:
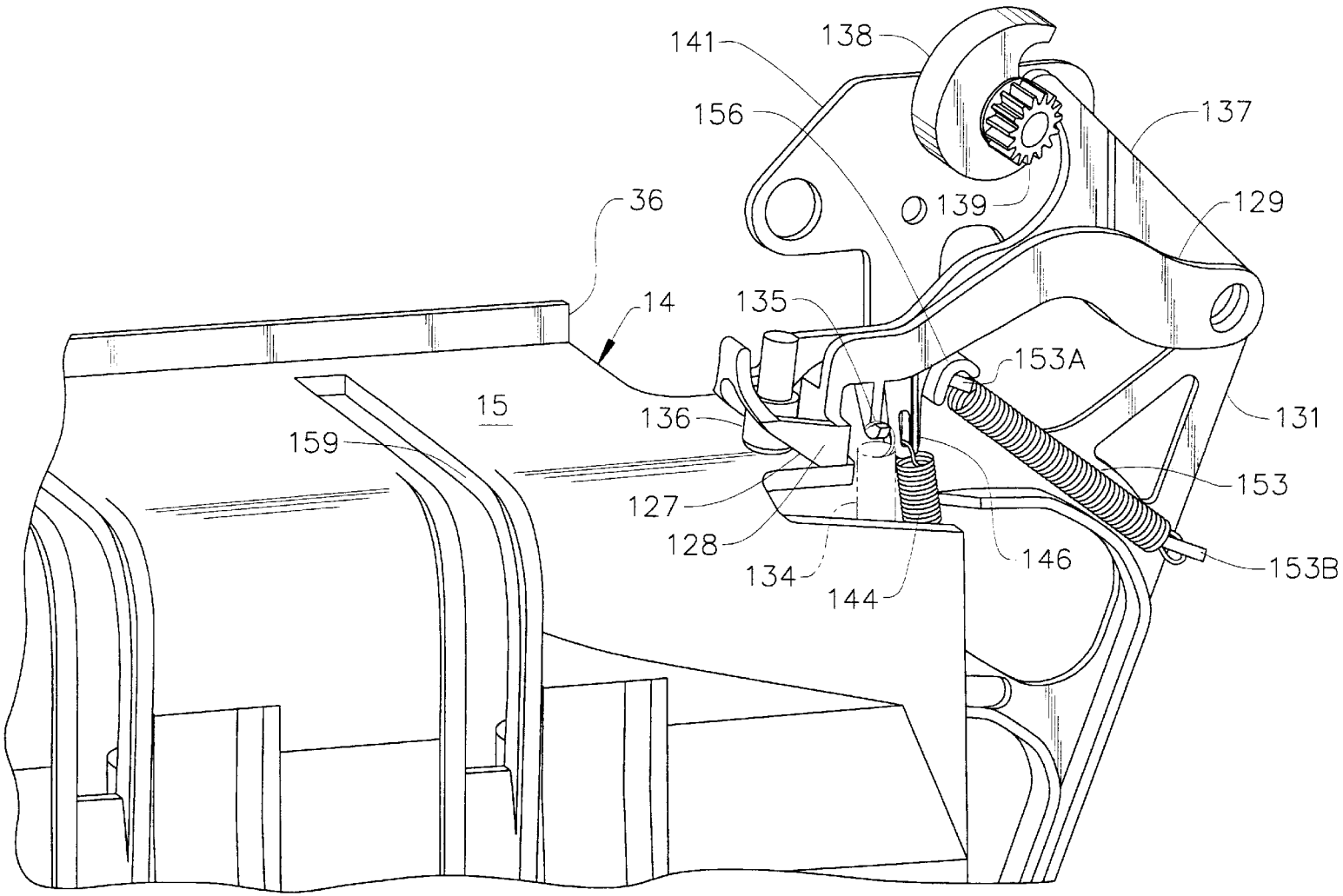
FIG. 17 is a perspective view of a clamp arm having a lower portion for receiving each sheet as it is advanced by the aligning roller towards the side reference barrier and a cam follower arm having a clamp for clamping each printed sheet after it is advanced against the side reference barrier.
Figure 18:
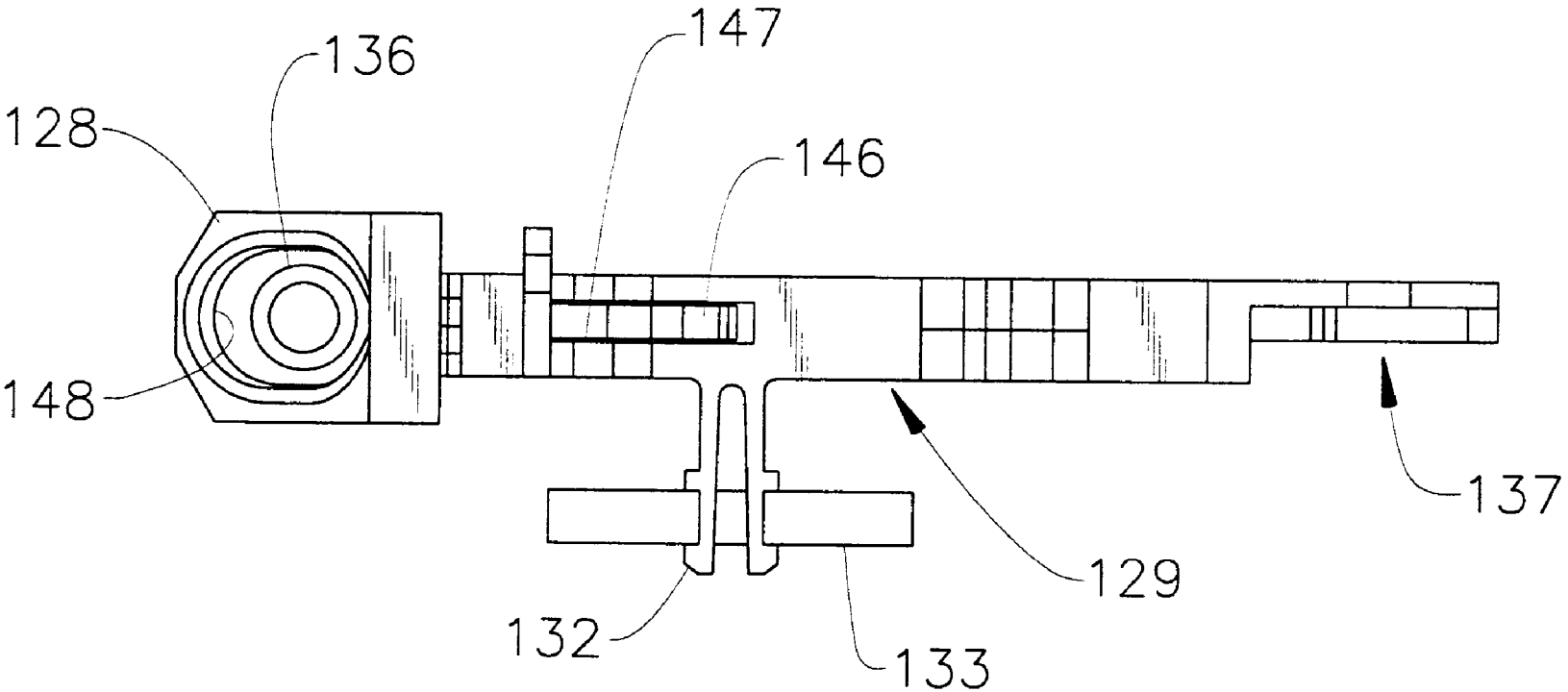
FIG. 18 is a bottom plan view of the clamp arm and the cam follower arm of FIG. 17.

As shown in FIG. 18, the clamp arm 129 has a support 132 extending from one side thereof and on which a counterweight 133 is retained by a snap fit. The force exerted by the counterweight 133 on the clamp arm 129 continuously urges the lower portion 128 (see FIG. 17) downwardly with a predetermined force. When the side edge 123 (see FIG. 11) of the printed sheet 12 approaches the side reference barrier 122, it engages the angled side surface 127 (see FIG. 17) of the lower portion 128 of the pivotally mounted clamp arm 129 before it reaches the side reference barrier 122 (see FIG. 11). The location of the lower portion 128 is shown in phantom in FIG. 11 relative to the rear wall 36 and the side reference barrier 122.

The counterweight 133 (see FIG. 18) provides a force of about seven grams. This force is sufficient to resist curl forces in each of the printed sheets 12 (see FIG. 11) as it moves under the lower portion 128 (see FIG. 17) of the pivotally mounted clamp arm 129.

While the counterweight 133 (see FIG. 18) is the preferred exerting force, it should be understood that the exerting force could be provided by other suitable means such as a spring 134 (shown in phantom in FIG. 17) extending between a spring anchor 135 on the clamp arm 129 and a spring retaining portion (not shown) on the lever 131.

As the side edge 123 (see FIG. 11) of the printed sheet 12 engages the side reference barrier 122, a clamp 136 (see FIG. 17 and shown in phantom in FIG. 11) on an end of a cam follower arm 137 is moved into engagement with the printed sheet 12 (see FIG. 11) to positively clamp the printed sheet 12 against the support surface 15 (see FIG. 17) of the accumulator table 14. The cam follower arm 137 also is pivotally mounted on the pivot pin 130 (see FIG. 16).

The pivotal movement of the cam follower arm 137 (see FIG. 17) is controlled by a cam 138 to remove the clamp 136 during alignment of each of the printed sheets 12 (see FIG. 11). A gear 139 (see FIG. 17) is integral with the cam 138. A stud 140 (see FIG. 16) rotatably supports the cam 138 and the gear 139. The stud 140 is supported on the plate 141 of the gear box 41.

The gear 139 is driven by the motor 80 through the gear train. The gear train includes a pair of bevel gears 142 and 143 to change the axis of rotation of the gear 139 90° from the axes of rotation of the gears of the portion of the gear train driving the gear 76. Thus, one revolution of the cam 138 occurs during each cycle of operation when the gear 76 is driven one revolution.

The cam follower arm 137 is continuously urged against the cam 138 by a spring 144 (see FIG. 17). The spring 144 is attached to the lever 131 and to an extension 146 of the cam follower arm 137.

As shown in FIG. 18, the extension 146 of the cam follower arm 137 extends through a slot 147 in the clamp arm 129. The spring 144 (see FIG. 17) maintains the cam follower arm 137 in contact with the cam 138. This insures that the clamp 136, which extends through a hole 148 (see FIG. 18) in the clamp arm 129, contacts the printed sheet 12 (see FIG. 11) only after the side edge 123 of the printed sheet 12 has engaged the side reference barrier 122. This clamping arrangement insures that the printed sheets 12 remain in their aligned relationship to which they have been moved.

The clamp 136 (see FIG. 17) remains in its sheet engaging position until the edge 123 (see FIG. 6) of the next of the sheets 12 approaches the reference barrier 122. When this occurs, the cam 138 (see FIG. 17) lifts the cam follower arm 137 to lift the clamp 136 so that the edge 123 (see FIG. 6) can move against the reference barrier 122. After the edge 123 of the sheet 12 has engaged the reference barrier 122, the cam 138 (see FIG. 17) drops the cam follower arm 137 to return the clamp 136 into contact with the printed sheet 12 (see FIG. 6) to clamp it and all of the sheets therebeneath.

Figure 19:
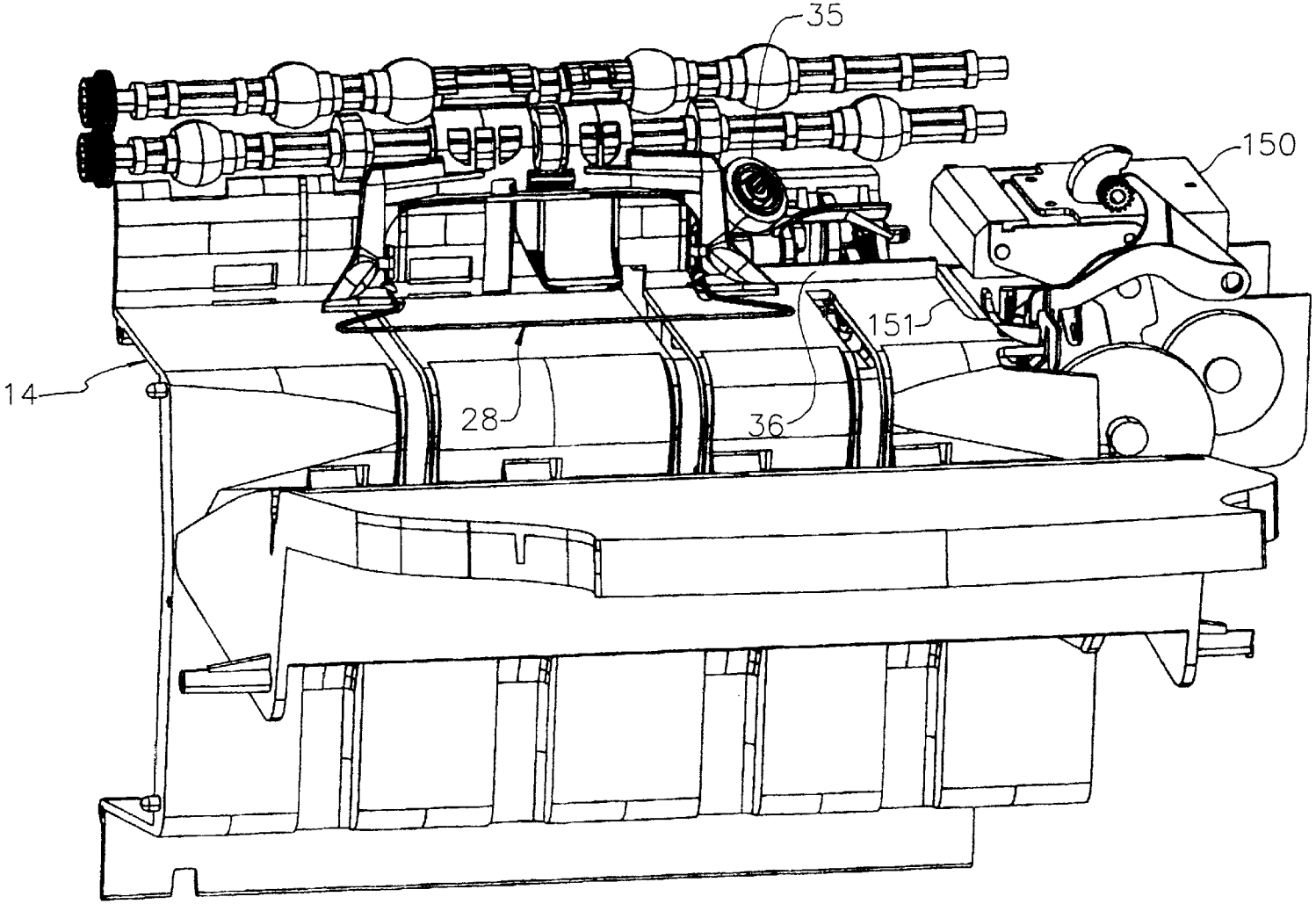
FIG. 19 is a front perspective view of the finisher and showing an electric stapler for stapling aligned stacked sheets.

This cycle continues until the number of the printed sheets 12 to be stapled together is accumulated. Then, an electric stapler 150 (see FIG. 19) is energized.

Figure 28:
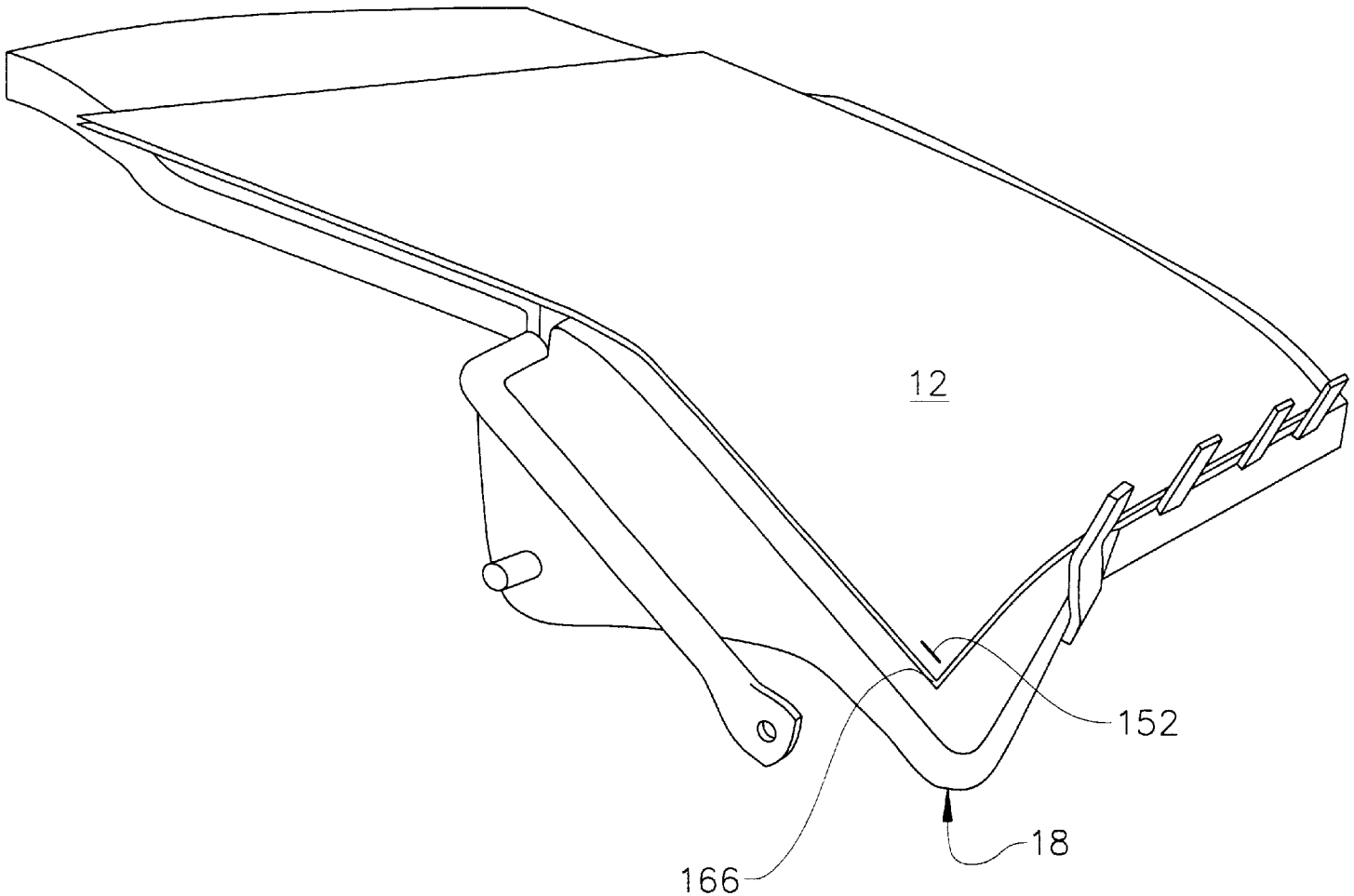
FIG. 28 is a perspective view of an inclined output tray having a single group of stapled sheets supported thereby with a recess or depression in the right rear corner of the inclined output tray for receiving the corner of the single group of stapled sheets having the staple.

The stapler 150 has a throat 151 through which a staple 152 (see FIG. 28) is pushed upwardly to staple the number of sheets selected in accordance with a microprocessor (not shown) in the finisher 11 (see FIG. 1). The printed sheets 12 (see FIG. 28) face downwardly so it is necessary for the staples 152 to be pushed upwardly through the throat 151 (see FIG. 19) to staple the aligned printed sheets 12 (see FIG. 11) to each other to form each group of the stapled printed sheets 12. It should be understood that the staple 152 (see FIG. 19) is in the upper left corner of each of the stapled sheets 12.

One suitable example of the electric stapler 150 (see FIG. 19) is sold by Max Co., Ltd., Tokyo, Japan as Model No. EH-320. Any other suitable electric stapler may be employed, if desired.

Figure 20:
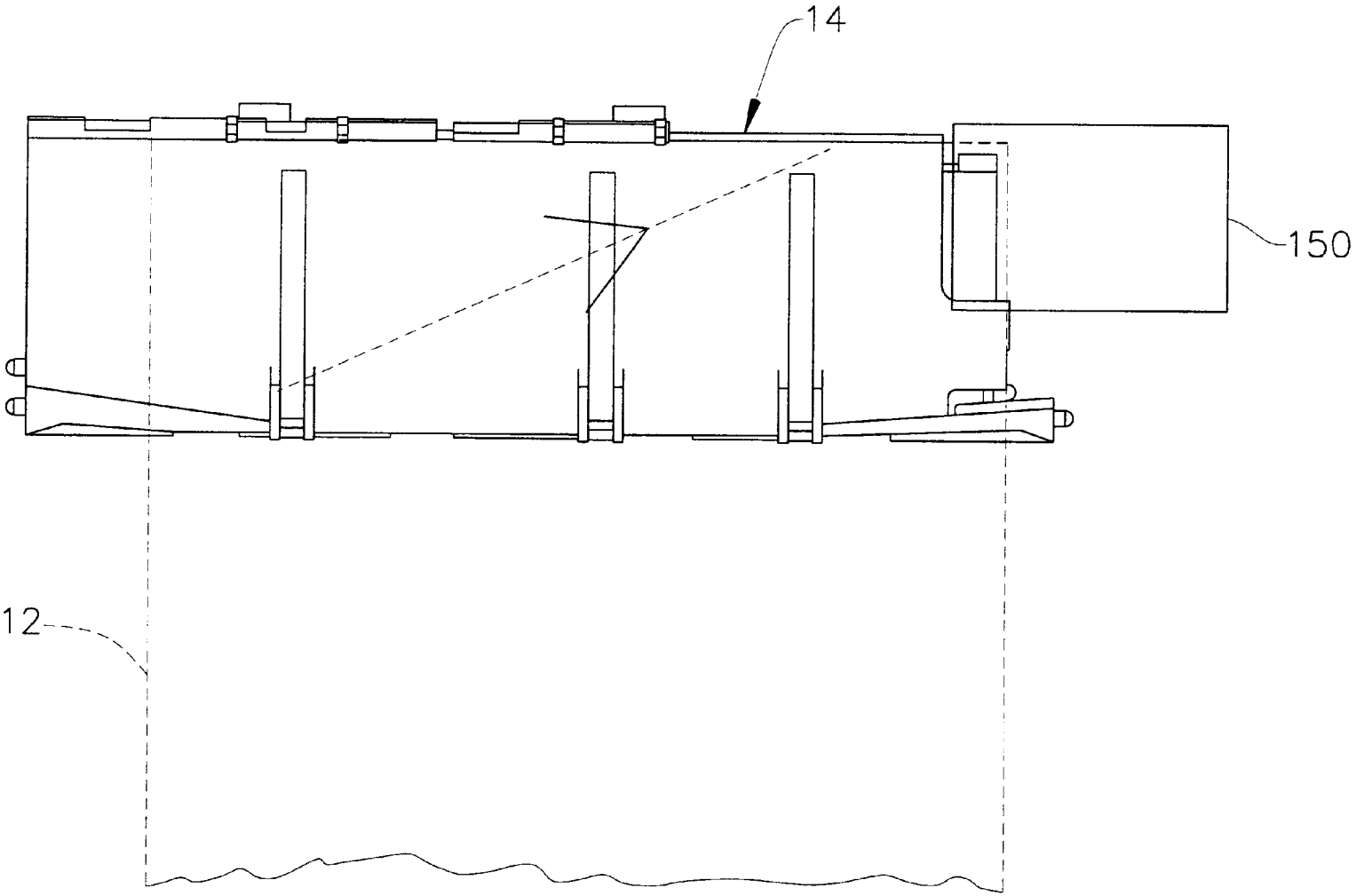
FIG. 20 is a top plan view of a portion of the accumulator table and showing the location of the electric stapler relative to each printed sheet at the aligned position.

After each group of the printed sheets 12 (see FIG. 20) has been stapled together by the stapler 150, the lower portion 128 (see FIG. 17) of the pivotally mounted clamp arm 129 and the clamp 136 on the cam follower arm 137 must be moved out of the path of the printed sheets 12 (see FIG. 11). This allows each group of the printed sheets 12 to be removed from any support by the upper support surface 15 (see FIG. 2) of the accumulator table 14 and advanced to the rearwardly inclined output tray 18 for complete support thereby. This occurs before the start of the next cycle of operation.

A spring 153 (see FIG. 17), which is attached to a hook 153A on the plate 141 and a hook 153B on the lever 131, continuously biases the lever 131 towards the clamp arm 129. A rod 155 (see FIG. 16) has its right end contacting a longitudinal arcuate surface (not shown) of the pivotally mounted lever 131. When the rod 155 is in the position of FIG. 16, the rod 155 overcomes the force of the spring 153 to prevent the spring 153 from causing the lever 131 to pivot clockwise about the pivot pin 130.

The lever 131 has a lifter 156 (see FIG. 17) connected thereto for engaging the clamp arm 129 and the cam follower arm 137 to cause each to pivot clockwise about the pivot pin 130 (see FIG. 16) when the rod 155 drops off an interior cam surface (not shown) of a cam 154. This clockwise pivoting of the clamp arm 129 and the cam follower arm 137 results in the lower portion 128 (see FIG. 17) of the pivotally mounted clamp arm 129 and the clamp 136 on the cam follower arm 137 being raised upwardly away from and out of the path of the printed sheets 12 (see FIG. 11).

The rod 155 (see FIG. 16) is moved to the left by the gear train in the gear box 41 rotating a gear 155', which is integral with the cam 154, to change the portion of the interior cam surface of the cam 154 engaging the rod 155 when the lever 131 is to pivot clockwise from the position of FIG. 17 to move the pivotally mounted clamp arm 129 and the clamp 136 on the cam follower arm 137 upwardly out of the path of the printed sheets 12 (see FIG. 11).

When the lower portion 128 (see FIG. 17) of the clamp arm 129 and the clamp 136 on the cam follower arm 137 are to be reset so as to again engage the next printed sheet 12 (see FIG. 1) as it is aligned, the gear train in the gear box 41 (see FIG. 16) further rotates the gear 155' to change the portion of the interior cam surface (not shown) of the cam 154 engaging the rod 155. This returns the rod 155 to the position in FIG. 16 in which it contacts the pivotally mounted lever 131 to hold it against the force of the spring 153.

The gear train in the gear box 41 also drives endless belts or bands 157 having pusher tabs 158 thereon. The pusher tabs 158 are utilized to push each group of the stapled printed sheets 12 (see FIG. 28) to the inclined output tray 18 after stapling and before the next cycle of operation. The belts or bands 157 ride in grooves 159 (see FIG. 17) in the support surface 15 of the accumulator table 14 and in the front portion of the accumulator table 14.

It should be understood that the belts or bands 157 (see FIG. 16) and the pivotally mounted lever 131 are only activated after a stapling operation is completed to move each group of the stapled printed sheets 12 (see FIG. 28) to the inclined output tray 18. If stapling is not occurring and each of the printed sheets 12 is not advanced for alignment, then the belts or bands 157 (see FIG. 16) and the pivotally mounted lever 131 are activated after each of the sheets 12 (see FIG. 2) is ejected onto the accumulator table 14. This activation of the belts or bands 157 (see FIG. 16) and the pivotally mounted lever 131 is controlled by the microprocessor (not shown) in the finisher 11 (see FIG. 1).

The inclined output tray 18 (see FIG. 2) has its sheet support surface 165 formed with a cutout recess or depression 166 in its right rear (as viewed from the front) corner. A wall 167 (see FIG. 1) of the finisher 11 constitutes a wall of the recess or depression 166 (see FIG. 2) of the inclined output tray 18.

Accordingly, after the stapled printed sheets 12 are stapled by the electric stapler 150 (see FIG. 20), each group of the stapled printed sheets 12 is advanced along the sheet support surface 165 (see FIG. 2) of the inclined output tray 18. This advancement positions the stapled portion of each group of the stapled printed sheets 12 with its staple 152 (see FIG. 28) disposed above the recess or depression 166 so that the portion of the printed sheet 12 having the staple falls therein until the recess or depression 166 is filled as shown in FIG. 30.

Figure 29:
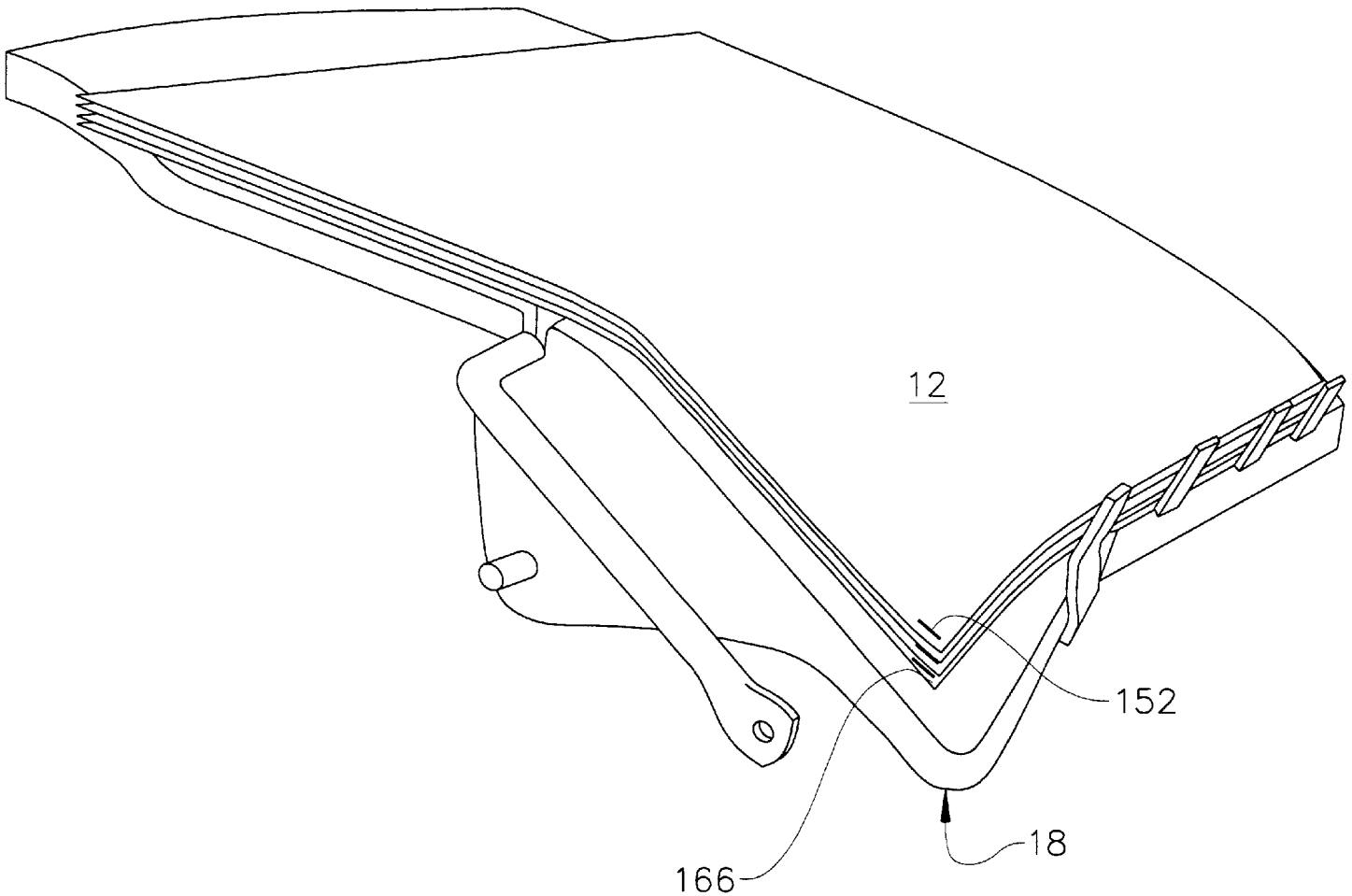
FIG. 29 is a perspective view of the inclined output tray of FIG. 28 with a plurality of groups of stapled sheets supported thereby.
Figure 30:
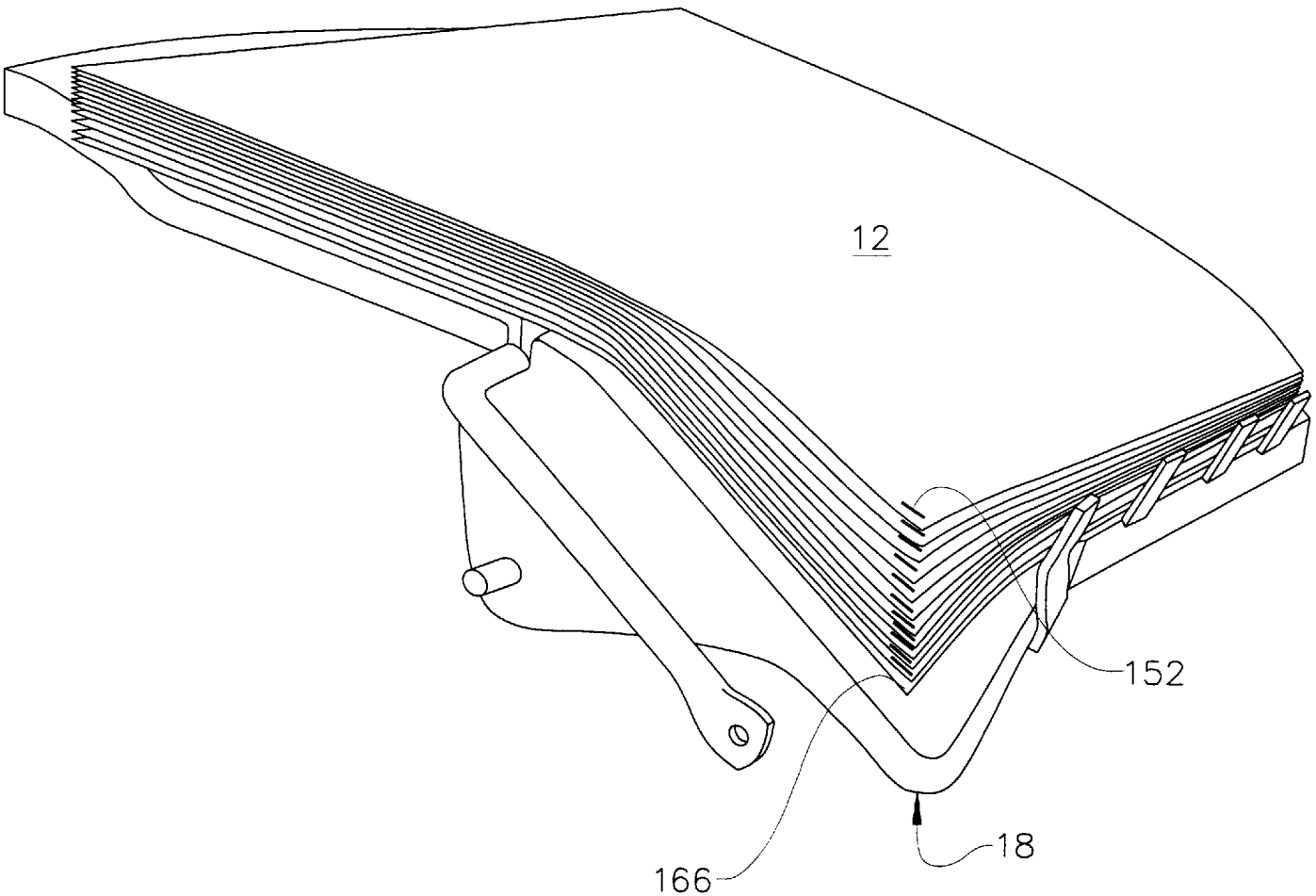
FIG. 30 is a perspective view of the inclined output tray of FIGS. 28 and 29 with the inclined output tray full of groups of stapled sheets supported thereby.

As the number of the groups of the stapled printed sheets 12 increases as shown in FIGS. 29 and 30, a larger number of the groups of the stapled printed sheets 12 can be disposed on the sheet support surface 165 of the inclined output tray 18 than in the prior inclined output tray, which did not have the recess or depression 166. The recess or depression 166 prevents the staples 152 from increasing the overall height of the right rear corner of the groups of the stapled printed sheets 12 as quickly to limit the capacity of the inclined output tray 18.

Thus, as shown in FIG. 30, it takes a relatively large number of the groups of the stapled sheets 12 before the stack in the right rear corner rises higher than the left rear corner. That is, the right rear corner becomes higher than the left rear corner only when the relatively large number of the groups of the stapled printed sheets 12 are stacked as shown in FIG. 30; this is when the inclined output tray 18 is full as indicated by a sensor (not shown).

It should be understood that the number of the stapled printed sheets 12 in each group of the stapled printed sheets 12 has a significant effect on how quickly the stapled corners of the stapled printed sheets 12 rise above the recess or depression 166. For example, when there are only two of the printed sheets 12 stapled to each other, the right rear corner of the stack of the printed sheets 12 rises quicker than if each of the groups of the printed sheets 12 had a larger number of the printed sheets 12 stapled to each other. This is because the thickness of the staple 152 is the determining factor in the overall thickness of each stapled group since the thickness of the staple 152 is much greater than the thickness of each of the printed sheets 12. With only two of the printed sheets 12 stapled together, a greater number of the staples 152 is present for the same total number of the printed sheets 12.

Figure 31:
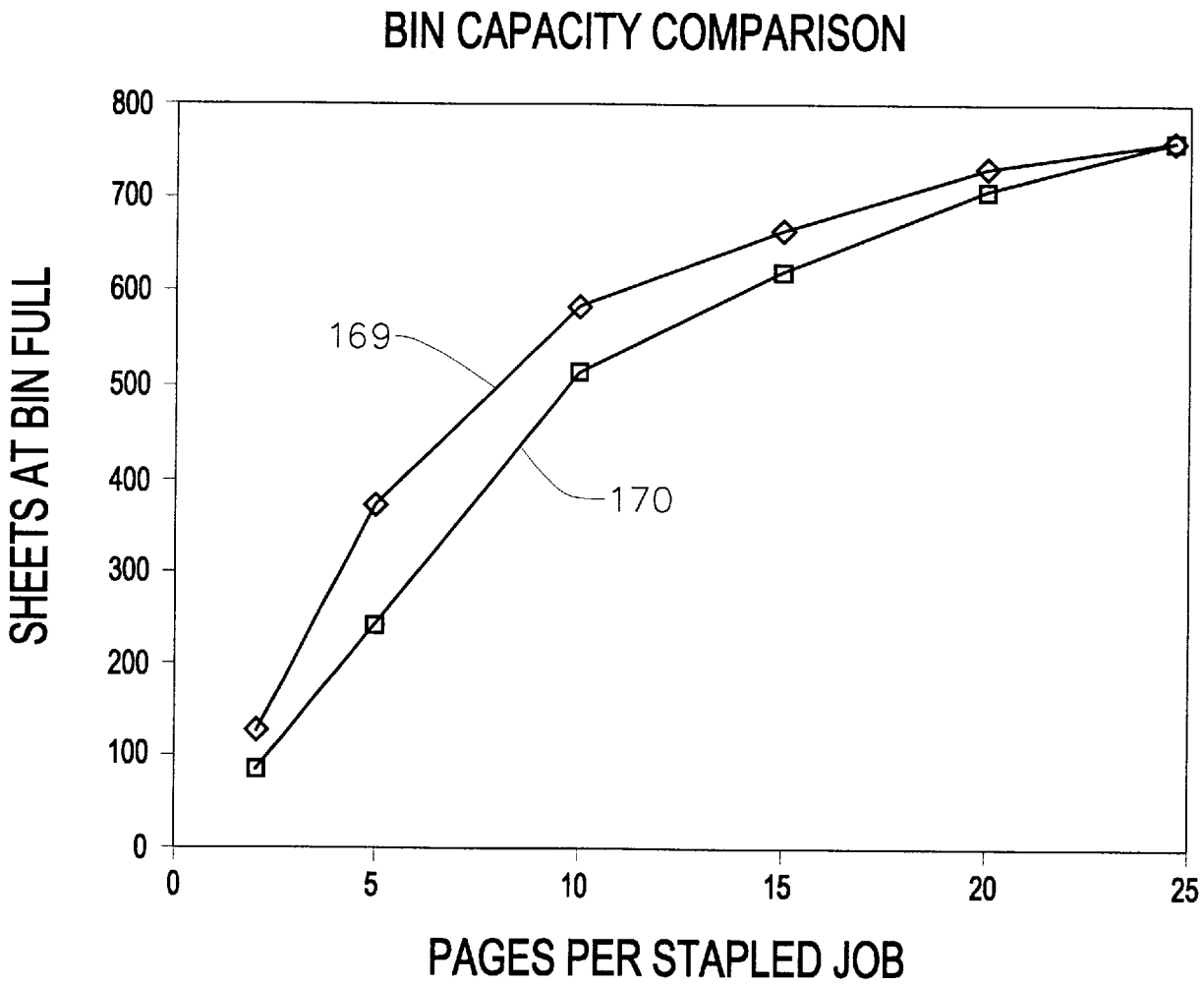
FIG. 31 is a graph comparing the capacity of the inclined output tray of FIG. 28 with its right rear corner having a recess or depression for receiving the stapled corners and the capacity of an inclined output tray with no recess or depression in its right rear corner with different numbers of sheets for each job or group.
Figure 32:
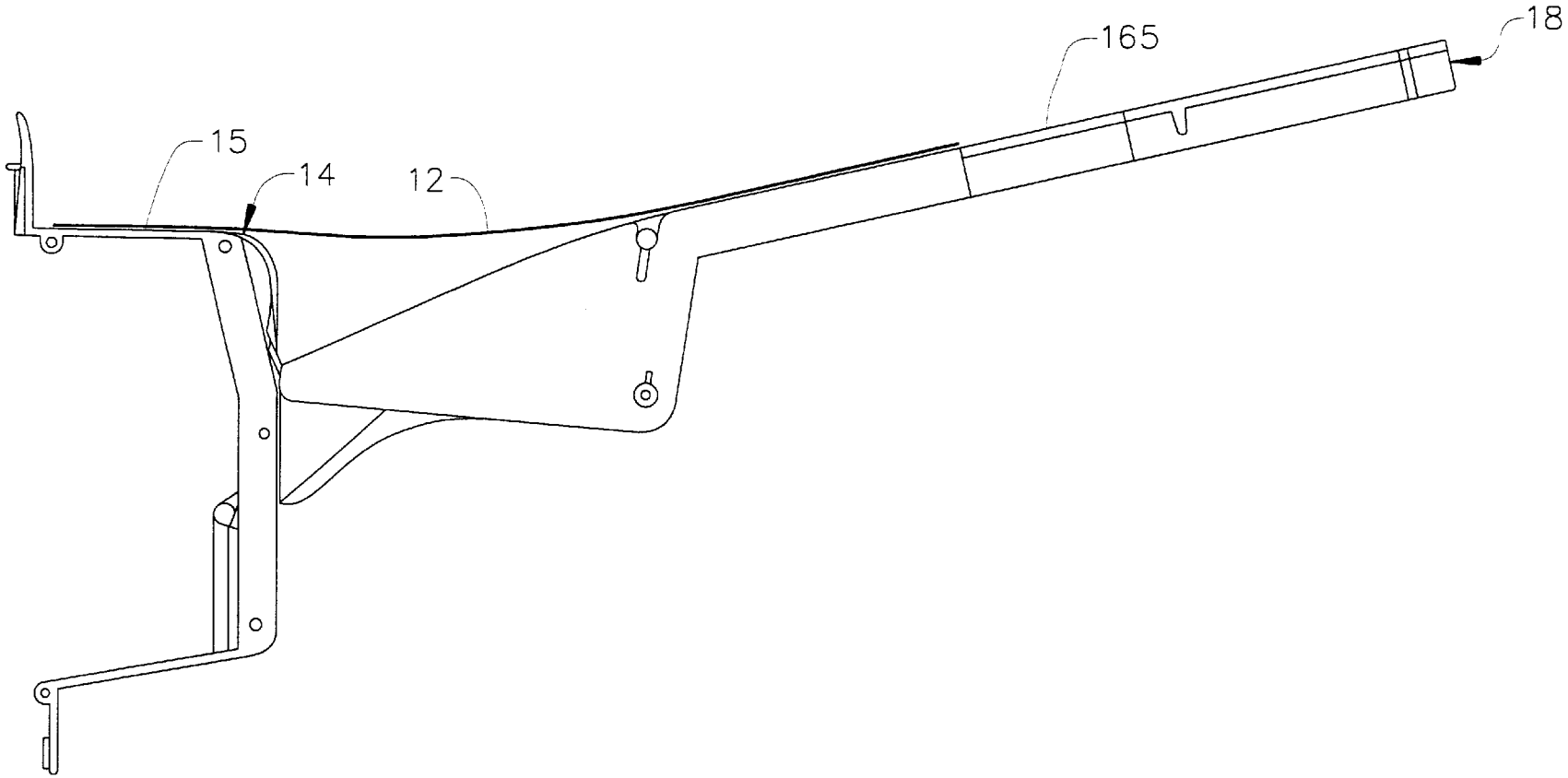
FIG. 32 is a side elevational view of the accumulator table and the inclined output tray with a printed sheet disposed thereon with its upwardly facing arch extending laterally.

The relation of the capacity of the inclined output tray 18 having the recess or depression 166 and the capacity of the inclined output tray 18 without the recess or depression 166 is shown by graph lines 169 and 170, respectively, in FIG. 31. This was based on the following results from comparison tests:

| Sheets/Job | Tray 18 with recess 160 | Tray 18 without recess 160 | Capacity increase (%) |
|---|---|---|---|
| 2 | 126 | 84 | 50.0 |
| 5 | 370 | 240 | 54.2 |
| 10 | 580 | 510 | 13.7 |
| 15 | 660 | 615 | 7.3 |
| 20 | 720 | 700 | 2.9 |
| 25 | 750 | 750 | 0.0. |

While the cutout recess or depression 166 (see FIG. 29) has been shown and described as being formed along two adjacent edges at the right rear corner of the support surface 165 of the inclined output tray 18, it should be understood that the recess or depression 166 could be formed along only one edge of the sheet surface 165, if the staple 152 were located at a different position in each of the stapled sheets 12.

While the roller shaft 49 (see FIG. 9) has been shown and described as driven by the helical gears 55 and 65 (see FIG. 7), it should be understood that other gears may be employed. For example, bevel gears may be utilized.

An advantage of this invention is that it prevents misalignment of a stack of sheets. Another advantage of this invention is that it is relatively quiet. A further advantage of this invention is that it requires only a single frictional member to position each sheet at a predetermined location when two orthogonal reference barriers, which define the predetermined location, are located different distances from the adjacent edges of the sheet. Still another advantage of this invention is that it prevents buckling of each sheet as its two edges are being advanced simultaneously towards two substantially perpendicular reference barriers.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A finisher to stack sheets moving in a predetermined direction including:

a support having an upper surface receiving each of the sheets separately for support thereby;

a roller movable from its home position in which each sheet can move in the predetermined direction for support by said upper surface of said support to a selected frictional contact position in which said roller makes frictional contact with each sheet after each sheet is separately directed in the predetermined direction for support by said upper surface of said support;

a rear reference barrier spaced rearwardly of a rear edge of each sheet supported by said upper surface of said support when each sheet is initially disposed for support by said upper surface of said support;

a side reference barrier substantially perpendicular to said rear reference barrier;

said rear reference barrier extending substantially perpendicular to the predetermined direction of each sheet;

said side reference barrier being spaced laterally from one side edge of each sheet when each sheet is initially disposed for support by said upper surface of said support;

sheet exiting apparatus to deliver individual sheets on to said support with the rear edge of said sheets delivered being within 10 mm of said rear reference barrier;

roller movement means for causing movement of said roller during each cycle of operation from its home position along a predetermined path to initial frictional contact with each sheet at the selected frictional contact position during a first predetermined portion of each cycle of operation;

rotation causing means for causing rotation of said roller when said roller is at the selected frictional contact position to advance each frictional contacted sheet simultaneously towards each of said rear reference barrier and said side reference barrier until the advancing sheet has its rear edge engage said rear reference barrier so as to be in alignment therewith and then to advance the frictional contacted sheet only toward said side reference barrier with its rear edge remaining engaged with said rear reference barrier so as to be in alignment therewith while sliding therealong until the frictional contacted sheet has its one side edge engage said side reference barrier so as to be in alignment therewith;

said roller having an alignment relative to each frictional contacted sheet when said roller is in contact therewith at the selected frictional contact position so that said roller is at an angle of from 60° to 70° relative to said side reference barrier to cause a greater force to always be exerted on the frictional contacted sheet by said roller towards said side reference barrier than towards said rear reference barrier;

said roller movement means causing removal of said roller from frictional contact with the sheet at the selected frictional contact position to return said roller to its home position after the frictional contacted sheet has its rear edge engaged with said rear reference barrier so as to be in alignment therewith and its one side edge engaged with said side reference barrier so as to be in alignment therewith;

and force maintaining means for maintaining a force on said roller to maintain said roller in engagement with each sheet during its advancement by said roller when said roller is at the selected frictional contact position.

2. The finisher according to claim 1 including:

a housing supported in a fixed position;

a power input supported by said housing;

a main shaft rotatably supported by said housing and driven by said power input for a plurality of revolutions during each cycle of operation at a predetermined velocity;

said roller movement means including pivotal mounting means pivotally mounted on said main shaft, said pivotal mounting means supporting said roller thereon for movement during the first predetermined portion of each cycle of operation from its home position along the predetermined path into frictional contact at the selected frictional contact position separately with each sheet supported by said upper surface of said support;

said pivotal mounting means holding said roller at the selected frictional contact position during a second predetermined portion of each cycle of operation while said rotation causing means causes rotation of said roller to advance simultaneously the rear edge of the frictional contacted sheet into engagement with said rear reference barrier so as to be in alignment therewith and the side edge of the frictional contacted sheet towards said side reference barrier and then to advance only the side edge of the frictional contacted sheet into engagement with said side reference barrier so as to be in alignment therewith;

and said pivotal mounting means removing said roller from the selected frictional contact position to return said roller to its home position during a third predetermined portion of each cycle of operation.

3. The finisher according to claim 2 including said pivotal mounting means being driven by said power input.

4. The finisher according to claim 3 including stapling means for stapling a plurality of stacked sheets to each other at selected time intervals inside of a vertical plane having said side reference barrier.

5. The finisher according to claim 1 including stapling means for stapling a plurality of stacked sheets to each other at selected time intervals inside of a vertical plane having said side reference barrier.

* * * * *